United States Patent [19]

Kidera et al.

[11] Patent Number: 4,585,681

[45] Date of Patent: Apr. 29, 1986

[54] FROST DAMAGE PROOFED PILE

[76] Inventors: Kenji Kidera, 2531 Ozenji, Aso, Kawasaki, Kanagawa; Shigeru Nakagawa, 44-2 Makigahara, Asahi, Yokohama, Kanagawa; Takashi Takeda, 8-8-1 Hisagi, Zushi, Kanagawa; Katsumi Omori, 2-17-22 Higiriyama, Konan, Yokohama, Kanagawa; Toshiyuki Okuma, 5-16-8 Nagao, Tama, Kawasaki, Kanagawa all of Japan

[21] Appl. No.: 624,750

[22] Filed: Jun. 26, 1984

[30] Foreign Application Priority Data

| | | | |
|---|---|---|---|
| Jun. 29, 1983 | [JP] | Japan | 58-116037 |
| Jun. 29, 1983 | [JP] | Japan | 58-116038 |
| Jun. 29, 1983 | [JP] | Japan | 58-116039 |
| Jun. 29, 1983 | [JP] | Japan | 58-116040 |
| Jun. 29, 1983 | [JP] | Japan | 58-99298[U] |
| Jun. 29, 1983 | [JP] | Japan | 58-99299[U] |
| Aug. 3, 1983 | [JP] | Japan | 58-141183 |
| Aug. 3, 1983 | [JP] | Japan | 58-141184 |
| Aug. 5, 1983 | [JP] | Japan | 58-121282[U] |

[51] Int. Cl.[4] ..... E02D 5/60

[52] U.S. Cl. ..... 428/36; 405/216; 405/231

[58] Field of Search ..... 405/231, 216, 130, 131; 428/36

[56] References Cited

U.S. PATENT DOCUMENTS

| | | | |
|---|---|---|---|
| 3,370,432 | 2/1968 | Butler et al. | 405/216 |
| 3,630,037 | 12/1971 | Howard | 405/231 |
| 4,512,683 | 4/1985 | Cosenza | 405/216 |

FOREIGN PATENT DOCUMENTS

| | | |
|---|---|---|
| 868128 | 4/1971 | Canada . |
| 874736 | 7/1971 | Canada . |
| 887937 | 12/1971 | Canada . |
| 929755 | 7/1973 | Canada . |

*Primary Examiner*—John E. Kittle
*Assistant Examiner*—James J. Seidleck

[57] ABSTRACT

A frost damage proofed pile for installment in a frigid district where the pile is subjected to a freezing and frost heaving force, such as permanently or seasonally frozen soil terrain. A tubular sheath member is fitted over the pile surface and has a length longer than the thickness of an active or seasonally frozen soil layer of the terrain in which the pile is installed. At least a portion of said length of the pile is formed as an extensible section, and at least the lower end of said sheath member is secured to the pile at or below a position corresponding to the bottom region of said active or seasonally frozen soil layer. A fluid material is filled in a space defined between the pile and the sheath member. The frost heaving force caused to exist upon freezing of the active or seasonally frozen soil layer as well as negative friction caused to exist in summer are inhibited from affecting the pile due to sliding of the sheath member relative to the pile.

36 Claims, 48 Drawing Figures

FROST DAMAGE PROOFED PILE

BACKGROUND OF THE INVENTION

This invention relates to a pile foundation as structural foundation used in a frigid area and, more particularly, to a frost damage proofed pile or pile secured against frost damage.

When a rack for a pipeline or a similar structure is installed in a frigid area such as permafrost area or seasonally frozen soil area, it is essential to protect the structure against frost damage such as freezing, frost heaving or thawing and resulting ground subsidence. To this end, various construction methods have been resorted to, including using a piling foundation, which appears to be most popular.

By permafrost area is meant a terrain or area such as Alaska, Canada or Siberia where the soild layer frozen through the year, hereafter referred to as permafrost, is distributed and where the annually averaged temperature is lower than 0° C. By the active layer is meant the soil layer extending from the ground surface to the permafrost layer. The active layer is affected severely by seasonal changes in temperature and subjected to freezing and frost heaving during winter while being also subjected to thawing and ground subsidence during summer. By the seasonally frozen soil area is meant the terrain where the annually averaged temperature is higher than 0° C. The seasonally frozen soil area is devoid of the permafrost and subjected to freezing during winter and thawing during summer. In the following description, the seasonally frozen soil layer is used synonymously as the active layer.

The pile foundation used in a frigid area is embedded in the permafrost for supporting the weight of the superstructure and the frost heaving force and the negative friction on the basis of the adfreeze strength between the permafrost and the pile surface. To this end, it is essential to provide for a positive freezing strength between the pile and the permafrost and a sufficient length of pile embedment in the permafrost. However, the permafrost is not necessarily of uniform properties, but may have variable values of freezing strength, depending upon the soil quality or temperature. Thus the structure may actually be subjected to frost damage even if the pile is embedded into the permafrost a distance designed to give a sufficient adfreeze strength. Thus it is required that a certain safety factor be taken into account when designing the pile length, thus causing disadvantages from the viewpoint of ease of construction and economy. There is a great need for an improved technique and system in setting piles in a frigid area.

SUMMARY OF THE INVENTION

This invention has been made in order to obviate the aforementioned disadvantages of the prior art. It is thus a principal object of the present invention to provide an arrangement in which means for reducing the frost heaving force acting on the pile upon freezing of the active or seasonally frozen soil layer and also reducing the negative friction generated in summer are annexed to the pile for protecting the superstructure against frost damage.

It is a further object of the present invention to provide a frost damage proofed pile in which a solid lubricating coating is provided to the pile surface, and in which means for reducing the frost heaving force acting the pile due to freezing of the active or seasonally frozen soil layer is annexed to the pile for protecting the superstructure against frost damage.

It is another object of the present invention to provide a frost damage proofed pile in which pile length may be adjustable in dependence upon the thickness of the active or seasonally frozen soil layer for enabling mass production and facilitated packaging and trasport and reducing manufacture costs.

These and other objects of the present invention are accomplished by the frost damage proofed pile which is characterized in that a tubular sheath member is fitted over the pile surface, said sheath member having a length longer than the thickness of an active or seasonally frozen soil layer of the terrain in which the pile is installed, at least a portion of said length being formed as an extensible section, at least the lower end of said sheath member being secured to the pile at or below a position corresponding to the bottom region of the active or seasonally frozen soil layer, with a fluid material being filled in a space defined between said pile and the sheath member.

According to a preferred embodiment of the present invention, a tubular sheath member is fitted over the pile surface, said sheath member has a length longer than the thickness of an active or seasonally frozen soil layer of the terrain in which the pile is installed, at least a portion of said length is formed as an extensible section, at least lower end of said sheath member is secured to the pile at or below a position corresponding to the bottom region of the active or seasonally frozen soil layer, upper end of said sheath member is secured to the pile at a position above the ground surface, and a fluid material is filled in a space defined between said pile and the sheath member.

According to a further embodiment of the present invention, a cylindrical sheath member of a elastic material is fitted over the pile, said sheath member has its lower end secured to the pile at or below a position corresponding to the bottom region of the active or seasonally frozen soil layer and its upper end secured to pile at a position above the ground surface, and a fluid material is filled in a space defined between the pile and the sheath member.

According to a further embodiment of the present invention, a sheath member having an extensible section in the form of a spiral and a length longer than the thickness of the active or seasonally frozen soil layer is fitted over the pile, at least the lower end of the sheath member is secured to the pile at or below the bottom region of the active or seasonally frozen soil layer, coil spring means are placed along the inner surface and/or the outer surface of said extensible member, and a fluid material is filled in the space between the pile and the sheath member.

According to a further embodiment of the present invention, a sheath member comprising a cylindrical section and an extensible section extending downward therefrom is fitted over the pile so that the extensible section is within the active or seasonally frozen soil layer, the lower end of the sheath member is secured to the pile at or below a position corresponding to the bottom region of the active or seasonally frozen soil layer, and a fluid material is filled in the space defined between the pile and the sheath member.

According to a further embodiment of the present invention, a plurality of sheath units are used, each said sheath unit having a cylindrical member of an inside diameter slightly larger than the outside diameter of the pile, and an extensible member having its upper and lower ends secured to the cylindrical member. A fluid material is filled in a space between the cylindrical member and the extensible member, at least two or more of said sheath units are fitted over the pile in tandem and connected to one another, and the uppermost and lowermost ends of the sheath units thus connected in tandem are secured to the pile.

According to a further embodiment of the present invention, a plurality of pile segments of predetermined shorter lengths are used, an extensible member is fitted over each said pile segment and has its upper and lower ends secured water-tightly to the outer periphery of the pile at positions ahead of the upper and lower ends of said pile segment. A fluid material is filled in the space defined by the pile and the extensible member to provide a pile unit, and a number of such units are connected to a total length corresponding to the thickness of the active layer.

According to still another object of the present invention, a plurality of cylindrical members, each being slightly larger in the inside diameter than the outside diameter of the pile, and a plurality of extensible tubular members, are used, said cylindrical members are introduced separately into the upper and lower ends of said extensible members so that said cylindrical members are partially exposed to the outside of the associated extensible members, the lowermost cylindrical member is secured to the pile, the cylindrical members lying thereabove are connected together, the space defined by the pile, the extensible member and the cylindrical member is filled with a fluid material, and the uppermost cylindrical member is secured to the pile.

In the above described embodiments of the present invention, it is contemplated by the present invention to provide a lubricating solid coating on the surface of the pile or the cylindrical member in advance, to divide the sheath member in advance into plural segments and to interconnect them to give a length corresponding to the particular thickness of the active layer, to provide the extensible section or member with the form of a spiral or bellows, to provide the extensible section or member with the form of bellows with ring members being interposed between the inner wall of the larger diameter portions of the extensible section or member and the pile, to provide the extensible section or member with the form of a spiral with coil spring means being interposed on the inner wall and/or the outer wall of the extensible section or member, or to provide a tank being located inside or outside of the pile and a pipe connecting said tank with a space defined by said pile and the extensible section or member. It should be noted that the frost damage proofed pile of the present invention may also be used in combination with a conventional frost damage proofed pile.

DESCRIPTION OF PREFERRED EMBODIMENTS

Before describing preferred embodiments of the present invention, some of the methods used heretofore for reducing the frost heaving force acting on the pile foundation will be described.

Figure 1:
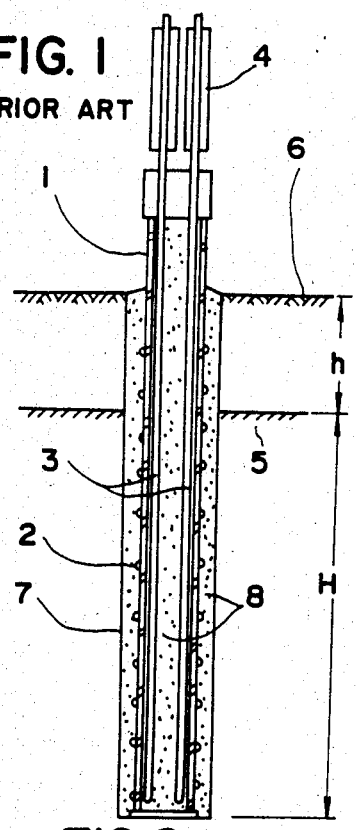
FIG. 1 PRIOR ART
FIGS. 1, 2*a*, 2*b* and 3 are diagrammatic views showing different forms of the prior-art frost damage proofed piles.
Figure 2A:
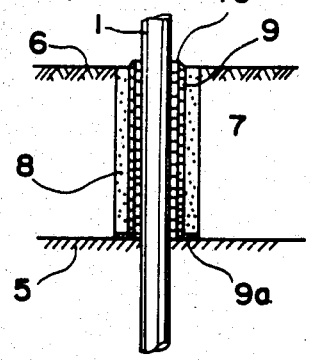
FIG. 2a PRIOR ART
Figure 2B:
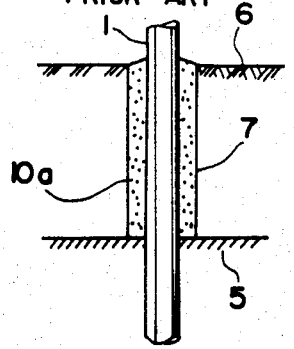
FIG. 2b PRIOR ART

Referring to FIGS. 1, 2*a*, 2*b* and 3, there are shown methods used heretofore in the permafrost area or in the seasonally frozen soil area for reducing the frost heaving force acting on the pile foundation. FIG. 1 shows a thermal pile system, While FIGS. 2*a* and 2*b* show an anti-frost-heaving pile and FIG. 3 an adfreeze strength augmenting pile system.

An example of the thermal pile system is shown in longitudinal section in FIG. 1, wherein the numeral 1 designates a pile, such as tubular steel pile or concrete pile, the numeral 2 an undulating member placed around pile 1 for improving adfreeze strength, the numeral 3 a heat pipe fitted within pile 1 and the numeral 4 a radiator. The numeral 5 designates a permafrost layer and the numeral 6 an active layer. The pile 1 is embedded in a hole 7 in the layers 6 and 5 and secured in place by backfill sand slurry 8. In the drawing, H designates the length of embedment of the pile 1 in the permafrost, and h the thickness of the active layer.

In the thermal pile system, as described above, heat is extracted from below the ground during winter by the action of the heat pipe 3 embedded in the permafrost 5 for reducing the thickness of the active layer subjected to thawing and freezing (thickness h of the active layer) for thereby improving the resistance to frost heaving. In addition, with the thermal pile system, described above, thawing of the permafrost around the pile 1 during summer is prevented from occurring because of the heat input from the superstructure. Thus, with the thermal pile system, there is no risk that the permafrost around the pile is thawed and subsided during summer thus causing negative friction to act on the pile, or that the soil is frozen during winter thus causing an excess frost heaving force to act on the pile.

However, with the thermal pile system, described above, it is not possible to drastically reduce the frost heaving force or negative friction, although the thickness h of the active soil layer 6 can thereby be reduced to some extent. Thus the system is not fully effective to prevent frost damage from occurring in the structure. For instance, during the first winter since installment of the thermal pile, the temperature in the deeper ground may be lowered so excessively that frost heaving amount becomes larger than in the case the thermal pile is not used, thus increasing the frost heaving force. From the second year on, the frost heaving force is increased possibly due to the lower temperature in the active layer 6 during winter. It is a conventional practice to increase the length of embedment H of the thermal pile in the permafrost for preventing frost damage. However, this is not desirable from the viewpoint of economy and increasing the ease of construction.

In the anti-frost-heaving pile system, the space delimited between the active layer and the peripheral surface of the pile is filled with a material capable of reducing the adhesion acting between the pile and the frozen soil. In an embodiment shown in FIG. 2*a*, a casing 9 is placed concentrically and externally of the pile 1 for providing a dual tube, and the space between the pile 1 and the casing 9 is filled with a mixture 10 of wax and oil of higher density, while the outer periphery of the casing 9 is surrounded by a backfill sand slurry 8 for effecting separation of the frost heaving force.

The numeral 9*a* designates a flange provided to the lower end of the casing 9. In an embodiment shown in FIG. 2*b*, a material 10 a consisting of a mixture of soil, oil and wax are used as back-filling material to be filled in a locating hole 7 in the active soil layer 6.

In the anti-frost-heaving system, described above, it is necessary that the mixture 10 be filled or back-filled about the periphery of the pile at the construction site with the aid of special machinery or apparatus and thus with additional costs and labor. Since the oil-wax mixture is fluid enough to be used at the construction site as back-filling material, there is the risk that the material be permeated or dispersed into the surrounding ground during summer, thus making it necessary to recharge the mixture. Moreover, the permanently frozen soil may be thawed during summer due to the freezing point depression thus causing the risk of environmental destruction. In addition, in the dual pipe system described above, the casing is caused to undergo alternate cycles of heaving or sinking as the result of the active soil becoming frozen or thawing, thus occasionally affecting the superstructure.

Figure 3:
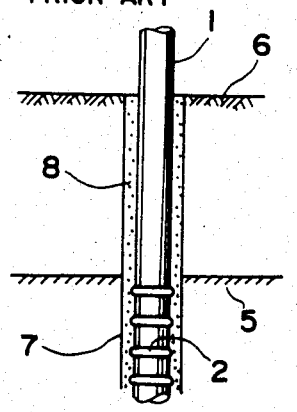
FIG. 3 PRIOR ART

In the freezing strength augmenting pile system, shown in FIG. 3, the portion of the pile 1 embedded in the permafrost 5 is provided with notches or undulations 2 for improving the adfreeze strength between the permafrost 5 and the pile 1 for providing resistance to the frost heaving force exerted by the active layer 6.

This system has however such an inconvenience that the permafrost surrounding the pile 1 is not necessarily of uniform quality and may have variable values of freeze strength. In additon, the frost heaving force is changed with the shape or intervals of the notches or undulations and thus considerable accuracy is required in machining the end portions of profiled steel sections in order to achieve a larger adfreeze strength.

Figure 4:
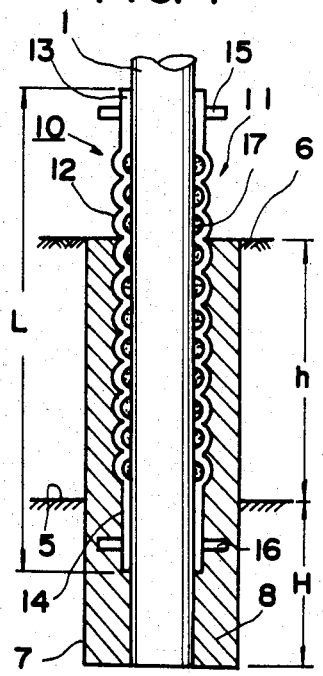
FIG. 4 is a longitudinal section showing a first embodiment of the present invention, in a first operating state.

FIG. 4 shows an embodiment of the present invention in longitudinal section. The parts same as those shown in FIGS. 1 to 3 are designated by the same numerals and the corresponding description is omitted for simplicity. The numeral 11 designates a tubular sheath having an intermediate extensible section 12 defined by a series of ribs extending transversely outwardly of the sheath member relative to a lengthwise axial line in the form of a bellows and upper and lower cylindrical end sections 13, 14. The upper cylindrical section 13 is secured to the pile 1 water-tightly at a position well above the ground surface with the aid of a fastener 15, while the lower cylindrical section 14 is secured to the pile 1 water-tightly at or below the boundary between the active layer 6 and the permafrost 5 with the aid of a fastener 16. The numeral 17 designates fluid material charged in the space between the pile 1 and the sheath 11.

Figure 6A:
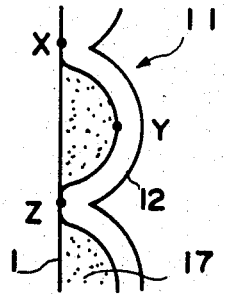
FIGS. 6*a* and 6*b* are enlarged views showing alternate forms of a portion of the embodiment shown in FIG. 4.
Figure 6B:
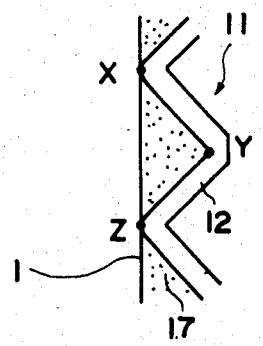

FIG. 6 shows essential parts of the extensible section 12 of the sheath 11 to an enlarged scale. It is only necessary that the length ratio of XYZ to XZ in the no-load state be larger than the maximum to minimum value ratio of the thickness h of the active layer 6 throughout the year. The extendable section 12 may be of straight shape, as shown in FIG. 6*b*, although the arcuate or sinusoidal shape or other kind of shape is preferred. The minimum radius points X, Z of the sheath 11 are preferably contacted with the pile 1 for reducing the amount of the fluid material 17. However, this is not limitative and the points X, Z may also be separated from the pile periphery.

In connection with the material of the sheath 11 used in the present embodiment, it is generally required that (i) it is not subjected to brittle destruction in the temperature range from ambient temperature of approximately 40° C. to an extremely low temperature of approximately −50° C.;

(ii) it is subject to a displacement larger than the frost heaving amount ($h_1-h$) of the active layer 6 without permanent set; and (iii) it is not attacked or deteriorated with the fluid material. However, the manner in which these requirements are applied will vary from area to area.

The following list 1 shows these typical materials.

List 1

Extendable structures consisting of various types of polyethylene, polyoxymethylene, polybutene-1, poly-1-pentene, polyvinylidene chloride, poly-tetra fluoro ethylene, polyamid 6 (nylon 6), polyamid 66 (nylon 66), vinyl acetate-ethylene copolymer, acrylate-acrylonitrile copolymer, complex materials (such as blends, copolymers or laminates) comprising two or more of these polymers, with or without inorganic fillers, or extendable structures consisting of natural rubber, isoprene rubber, styrene-butadiene rubber, butadiene rubber, chloroprene rubber, butyl rubber, ethylenepropylene rubber, ethylene-propyrene-diene rubber, nitroso rubber, polyester urethane rubber, polyether urethane rubber, silicon fluoride rubber, phenyl-methyl-silicon rubber, methyl-silicon rubber, vinyl-silicon rubber, polysulfide rubber, epichlorohydrine rubber or, styrene-chloroprene rubber, or a complex comprising two or more of these rubbers.

In connection with the fluid materials 17, it is generally required that (i) it remains in the fluid state in the temperature range from the ambient temperature of approximately 40° C. to a low temperature of approximately −50° C. and (ii) it does not attack or otherwise deteriorate the material of the pile 1 and the sheath 11.

The following list 2 shows these typical materials.

List 2

Monohydric alcohols, monolydric alcohol-water, isoparaffinic hydrocarbons, polybutene, $C_6$–$C_9$ alkane, $C_6$–$C_{11}$ n-alkene-1 or internal n-alkene, $C_{12}$ or $C_{13}$ n-alkylbenzene, $C_5$ to $C_7$ fatty acid nitrile, $C_6$ to $C_8$ 1-fluoralkane, 1-chloroalkane, 1-bromalkane, 1-iodoalkone, n-alkanethiol, monohydric alcohol ester, methyl ester, ethyl ester or chloride of caproic acid or enantoic acid, low molecular weight grease, gasoline, general-purpose oils such as light oil or mineral oil, fluid materials consisting of one or more of these ingredients, or gases with dew points less than −50° C. (such as nitrogen or dry air).

The frost damage proofed pile constructed as described above are installed by the following sequence of operations.

(i) The layers 5, 6 are bored to a depth equal to the depth of embedment (h+H) of the pile 10, which is located within a bored hole 7 formed in the ground. The space around the pile 10 is charged with backfill sand slurry 8. In the above, h stands for the thickness of the active layer 6 and H the length of embedment of the pile in the permafrost 5.

(ii) In the event that the permafrost 5 has an inferior strength, or the pile is to be embedded into the unfrozen soil, the hole 7 is formed in the layer 6 only and, after the pile 10 is located in the hole 7, the pile 10 is driven by a pile driver, not shown, into the permafrost or unfrozen soil, after which the space around the periphery of the pile portion located in the active layer is charged with backfill sand slurry 8.

Figure 5:
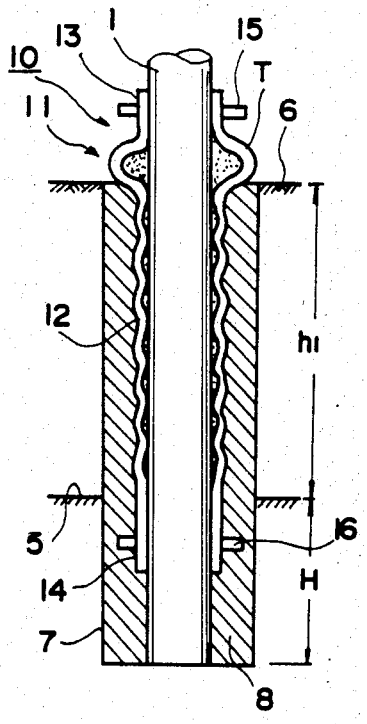
FIG. 5 is a view similar to FIG. 4 and shown the first embodiment in a second operating state.

The operation of the thus installed frost damage proofed pile according to the present invention is now described by referring to FIGS. 4 and 5. FIG. 4 shows the state in which the pile 10 according to the present invention is installed in the hole 7 formed in the active layer 6 and the permafrost 5, and the state of the installed pile in summer. When the active layer 6 becomes frozen in winter, sand slurry 8 is also frozen and becomes affixed to the surface of the sheath 11 of the pile 10. The fluid material 17 filled in the space between the pile 1 and the sheath 11 acts to reduce the sliding resistance between the pile 1 and the sheath 11. Thus, in the event of the frost heaving of the active layer 6, the sheath 11 is elevated and extended along the pile 1 so as to follow up with heaving of the layer 6, as shown in FIG. 5. Since the sheath 11 is secured at the upper and lower cylindrical sections 13, 14 to the pile 1, an expanded zone T is formed below the stationary section 13 with extension of the section 12.

As the sheath 11 is extended in this manner, the fluid material 17 filled in the space between the pile 1 and the sheath 11 is shifted upwards and gathered in the expanded zone T. In this manner, the frost heaving force exerted by the active layer 6 on the pile 1 is absorbed by the sheath 11 and the fluid material 17 without being transmitted to the pile 1.

When the active layer 6 is thawed and caused to sink during summer, the sheath 11 is also lowered so as to follow up with sinking of the soil layer to return to the state shown in FIG. 4. It should be noted that the negative friction caused with thawing and sinking of the active layer 6 is absorbed by the fluid material 17 without substantially affecting the pile 1.

Figure 7:
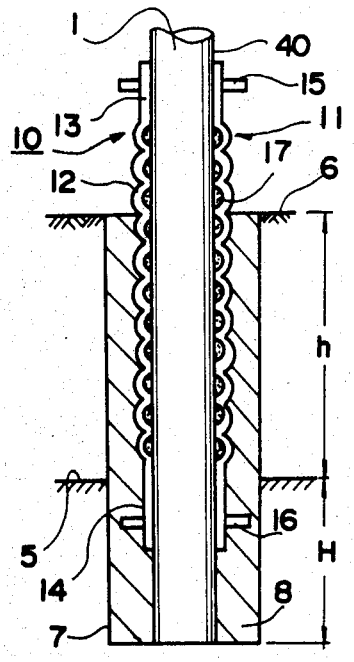
FIG. 7 is a longitudinal section showing a second embodiment of the present invention.

FIG. 7 shows a modified embodiment of the present invention in longitudinal section. The parts same as those shown in FIG. 4 are depicted by the same reference numerals and the corresponding description is omitted for simplicity. According to the present embodiment, the surface of the pile 1 and preferably that of a length of the pile 1 which is slightly longer than the thickness of the active layer 6 is coated in advance with a solid lubricating coating 40 by for example, spray coating.

In connection with the material of the solid coating 40 used in the present embodiment, it is required that (i) it has a coefficient of friction relative to the sheath 11 lesser than the coefficient of friction of the pile 1 relative to the sheath 11 and (ii) it can be applied by coating on the pile surface. The following list 3 shows examples of the materials satisfying these requirements.

List 3

Coating materials consisting essentially of molybdenum disulfide ($MoS_2$); black lead; PbO;$NaMoO_4$; Polytetra fluoro ethylene (PTFE); phtalocyanine; coating materials consisting essentially of Ag, Au, Pb, In, Ba, Mo-$MoS_2$, Ag-PTFE-WSe2, or plastic materials capable of being applied to the pile, such as polyolefines or epoxy resins.

It should be noted that the materials shown in the list 1 may be used for the sheath 11 and those shown in the list 2 may be used for the fluid materials 17.

The operation of the present embodiment is similar to that of the embodiment shown in FIG. 4.

In the frost damage proofed pile shown in FIG. 4, the sheath 11 is extended and contracted along the length of the pile 1 due to freezing and the resulting heaving of the active layer in winter and thawing and resulting sinking of the same layer in summer, in such a manner that the inner wall of the lesser diameter portions of the sheath 11 are slid at all times against the pile surface. This causes excessive wear and damage to the contact portion of the sheath 11 with the pile 1. Above all, when a gaseous medium is used as fluid material 17, the sheath 11 is damaged so severely that it is incapable of being used for prolonged time.

Figure 8A:
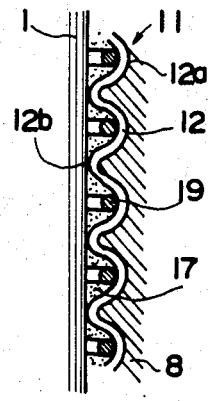
FIGS. 8*a*, 8*b*, 9*a*, 9*b*, 9*c* and 9*d* are diagrammatic views showing several alternate forms of the extensible section of the present invention for illustrating the operation thereof.
Figure 8B:
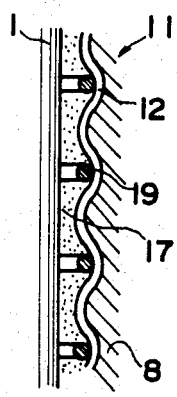
Figure 9A:
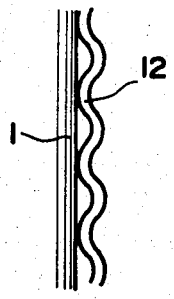
Figure 9B:
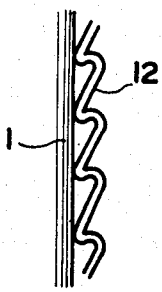
Figure 9C:
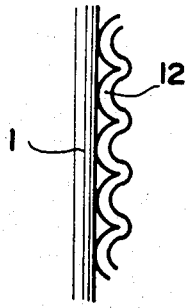
Figure 9D:
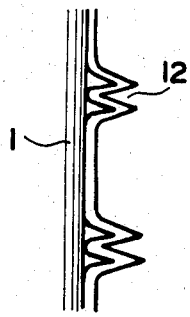

FIGS. 8*a*, 8*b* show a further embodiment of the present invention in longitudinal section. According to the present embodiment, a ring member 19 is installed in advance between the inner periphery of each larger diameter portion 12*a* of the extendable section 12 and the pile 1. It is to be understood that the solid film 40 may or may not be applied in advance to the surface of the pile 1. These ring members are effective to prevent deformation or damage of the extendable section 12 due to the pressure acting on the active layer 6 through the sand slurry 8. FIG. 8*b* shows the relative position assumed by the pile 1, sheath 11 and the rings 19 when the active layer 6 becomes frozen and subjected to frost heaving. It should be noted that these ring members 19 may be placed around the outer periphery of the lesser diameter portions 12*b* of the extendable section 12, or embedded in the extendable section 12.

The profile of the extendable section 12 shown in the above described embodiments is given by way of illustrative examples only and the profile shown for example in FIGS. 9*a* to 9*d* may be used without departing from the scope of the present invention.

Figure 10:
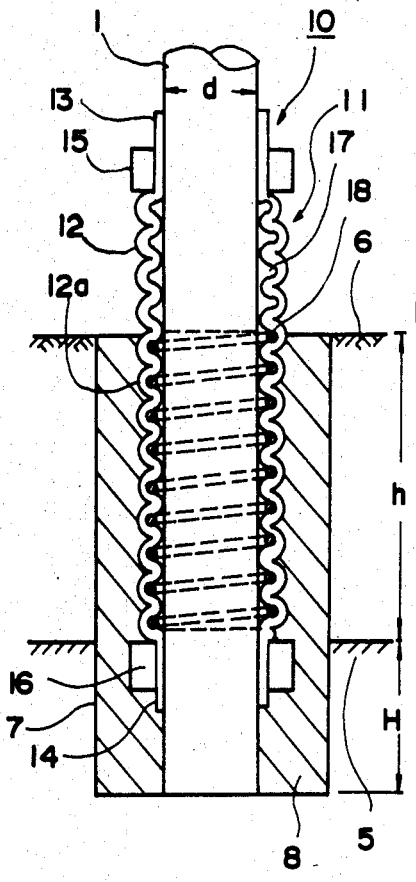
FIG. 10 is a longitudinal section showing a third embodiment of the present invention, in a first operative state.
Figure 11:
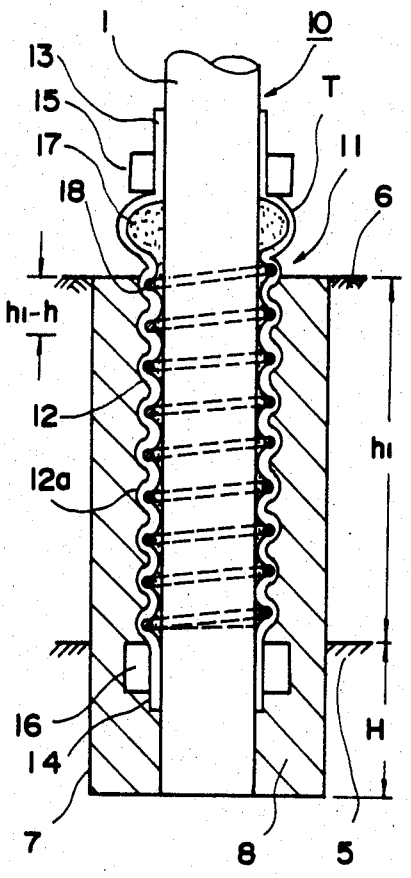
FIG. 11 is a view similar to FIG. 10 and showing the third embodiment in a second operative state.

FIG. 10 shows a further embodiment of the invention in longitudinal section. In this figure, the parts same as those shown in FIG. 4 are indicated by the same reference numerals and the corresponding description is omitted for simplicity. The numeral 11 designates a sheath having an intermediate extendable section 12 in the form of a spiral and upper and lower cylindrical sections 13, 14, and the numeral 18 a coil spring placed along the inner wall of the larger diameter portions of the extendable section 12. The function of the coil spring 18 is to help restore the sheath 11 to its original configuration during the summer when the active layer 6 is shawed and sunk, and to prevent excess deformation of the sheath 11 such as excess compression, collapse or expansion during winter when the active layer 6 becomes frozen. In this manner, when the sheath 11 is extended in winter, there is no risk that the fluid material 17 charged into the interior space of the sheath 11 be allowed to flow only up or down and reside there predominantly.

The spring 18 is required to be of such strength that it can be expanded during winter to follow up with frost heaving and contracted during summer to follow up with thawing and sinking of the active layer. Thus, with the force of frost heaving P(N/m$^2$) acting on the pile 10, the force of negative friction S (N/m$^2$), the diameter d (m) of the pile 10, the frost heaving amoung or sinking amount of the active layer $(h_1-h)=\Delta l$ (m), the thickness of the active layer during summer h=ls (m) and the thickness of the same layer during winter $h_1$=lw(m), the spring 18 is required to have a spring constant k (N/m) such that (For winter) (1)

$$0 < k \leqq \frac{\pi \cdot d \cdot P \cdot lw}{\Delta l}$$

(For summer) (2)

$$0 < k < \frac{\pi \cdot d \cdot S \cdot ls}{\Delta l}$$

However, since the negative friction is lesser in magnitude than the frost heaving force it is required that the spring be contractile relative to the negative friction. In addition, the material of the spring 18 is selected so that (i) it is not subject to brittle destruction in the range of temperature from ambient of approximately 40° C. to a low temperature of approximately −50° C.;

(ii) it can be extended or deformed within the range of about 10 percent of the original length usually encountered with frost heaving; and (iii) it is not attacked or otherwise deteriorated by the fluid material 17. Thus, stainless steel is preferred by way of an example. It should be noted that the materials shown in the lists 1, 2 may be used as the sheath 11 and the fluid material 17, respectively.

In the present embodiment of the pile, when the active layer 6 becomes frozen in winter, sand slurry 8 is also frozen and affixed to the surface of the sheath 11 of the pile 10. With frost heaving of the active layer 6, the extendable section 12 is also extended along the length of the pile 1 together with the spring 18 so as to follow up with soil heaving. However, since the upper and lower cylindrical sections 13, 14 are secured to the pile 1, the expanded zone T is formed below the fastener 15 in the thus extended section 12.

As the section 12 is extended in this manner, the fluid material 17 in the space between the pile 1 and the section 12 is displaced upward and collected within the expanded zone T. In this manner, the frost heaving force of the active layer 6 is absorbed by the extendable section 12 and the fluid material 17 without being transmitted to the pile 1. Moreover, when the section 12 is compressed with freezing of the active layer 6, it is protected by the spring 18 from collapsing or becoming otherwise deformed so that there is no risk of the above described preferential collection of the fluid material 17.

When the active layer 6 is thawed and sunk during summer, the sheath 11 is lowered and restored to the state shown in FIG. 10. It should be noted that the negative friction produced with thawing and sinking of the active layer 6 is absorbed by the extendable section 12 and by the fluid material 17 without being transmitted to the pile 1. As another function of the spring 18, the extendable section 12 may be lowered and returned to its original profile smoothly and positively.

Figure 12A:
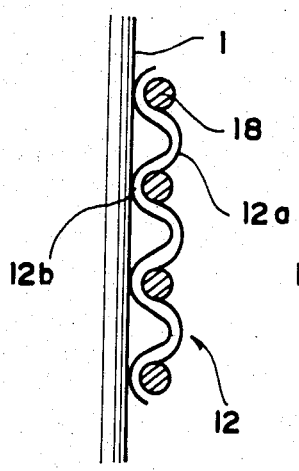
FIGS. 12*a* and 12*b* are partial enlarged views showing two alternate forms of the extensible section of the third embodiment
Figure 12B:
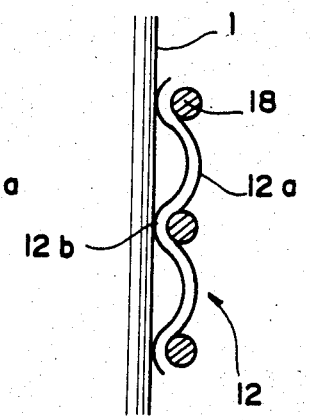
Figure 13A:
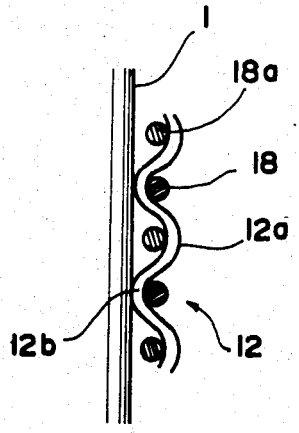
FIGS. 13*a* and 13*b* are partial enlarged views showing still further alternate forms of the extensible section.
Figure 13B:
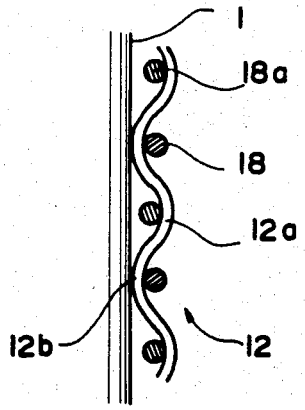

FIG. 12*a* shows only essential portions of a further embodiment of the invention, wherein the spring 18 is placed along the outer periphery of the lesser diameter portions 12*b* of the extendable section 12. FIG. 12*b* shows the operation of the present embodiment. FIG. 13*a* similarly shows only essential portions of a further embodiment wherein springs 18, 18*a* are installed along the outer periphery of the lesser diameter portions 12*b* and the inner periphery of the larger diameter portions 12*a* of the extendable section 12, respectively FIG. 13*b* shows the operation of the present embodiment.

Figure 14:
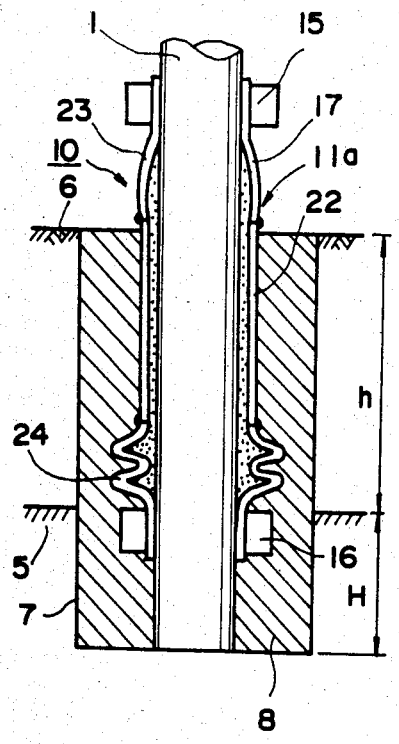
FIG. 14 is a longitudinal view showing a fourth embodiment of the present invention, in a first operative state.
Figure 15:
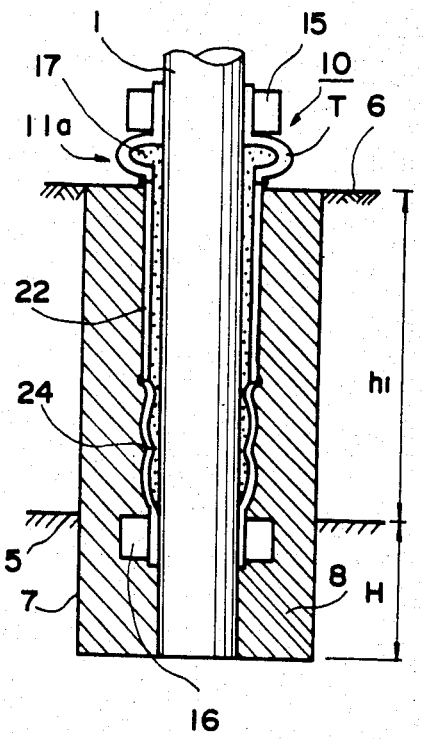
FIG. 15 is a view similar to FIG. 14 and showing the fourth embodiment in a second operating state.

FIG. 14 shows a further embodiment of the present invention in longitudinal section. In this figure, the parts same as those shown in FIG. 4 are indicated by the same reference numerals and the corresponding description is omitted for simplicity. In the present embodiment, a tubular section 22, an upper extendable section 23 and a lower extendable section 24 are formed as distinct elements and are connected together to a unitary sheath member 11*a*. The upper extendable section 23 is secured to the pile 1 above the ground surface with a fastener 15, and the lower extendable section 24 is secured to the pile 1 at or below the boundary between the active layer 6 and the permafrost 5 with a fastener 16. The space between the pile 1 and the sheath 11 is filled with the fluid material. The materials of the sheath 11*a* and the fluid material 17 as well as combination thereof and the method of construction are the same as already described with reference to FIG. 4.

In the frost damage proofed pile 10, when the active layer 6 is frozen in winter and subjected to frost heaving, the tubular section 22 and the lower extendable section 24 are raised so as to follow up therewith so that the lower section 24 is extended. The result is that the upper extendable section 23 is deformed for forming an expanded zone T into which the fluid material 17 expulsed out of the lower section 24 is accommodated. The operation of the present embodiment is otherwise similar to the embodiment shown in FIGS. 4 and 5.

The results of tests carried out in a refrigerating chamber by using the conventional steel tube pile and the frost damage proofed pile according to the present invention are hereafter described. The device used in the present tests is shown in FIG. 16 and comprised of a pair of upright frames 42, 42 erected on a foundation 41, a reaction frame 43 interconnecting these frames, a soil vessel 45 placed on the foundation 41 and filled with soil 46, an insulation 44 which is 100 mm in thickness and placed about the vessel 46, a simulated or model pile 47 located in the soil 46, a load cell 48 interposed between the model pile 47 and the reaction frame 43 and a displacement gauge 49 designed for measuring surface displacement of the soil 46 in the vessel 45.

TEST EXAMPLE I

A steel tube pile (conventional) with an outside diameter equal to 34 mm, length equal to 400 mm, and a length of embedment equal to 250 mm was used. The frost damage proofed pile (corresponding to the embodiment shown in FIG. 4) used was 27.5 mm outside diameter, 400 mm length and 250 mm embedment length . The sheath of low density polyethylene with thickness equal to 1.5 mm, a crest pitch equal to 9.0 mm, a crest to root height gap equal to 6.0 mm and a sheath length equal to 300 mm was used. The fluid material used was $C_{13}$–$C_{18}$ isoparaffin.

Figure 16:
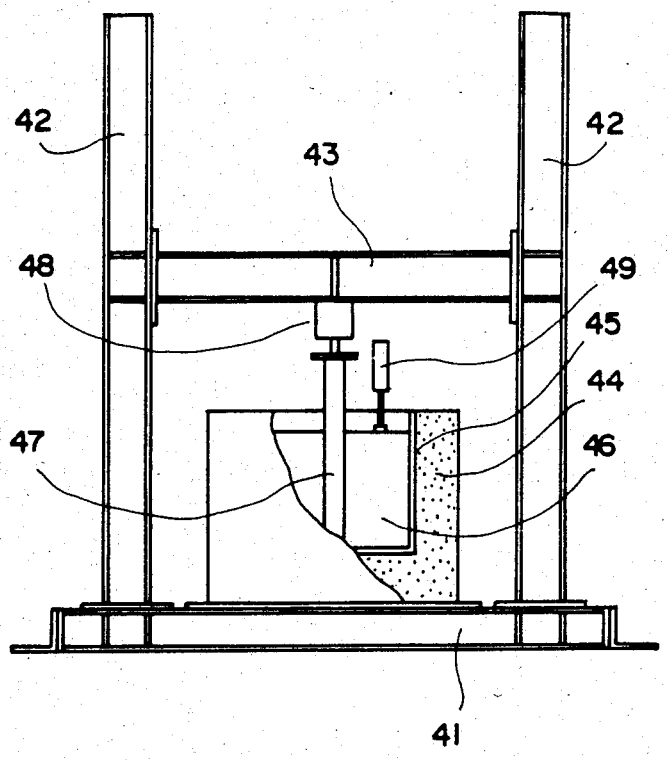
FIG. 16 is a diagrammatic view showing a device for testing the operation of the pile.
Figure 17:
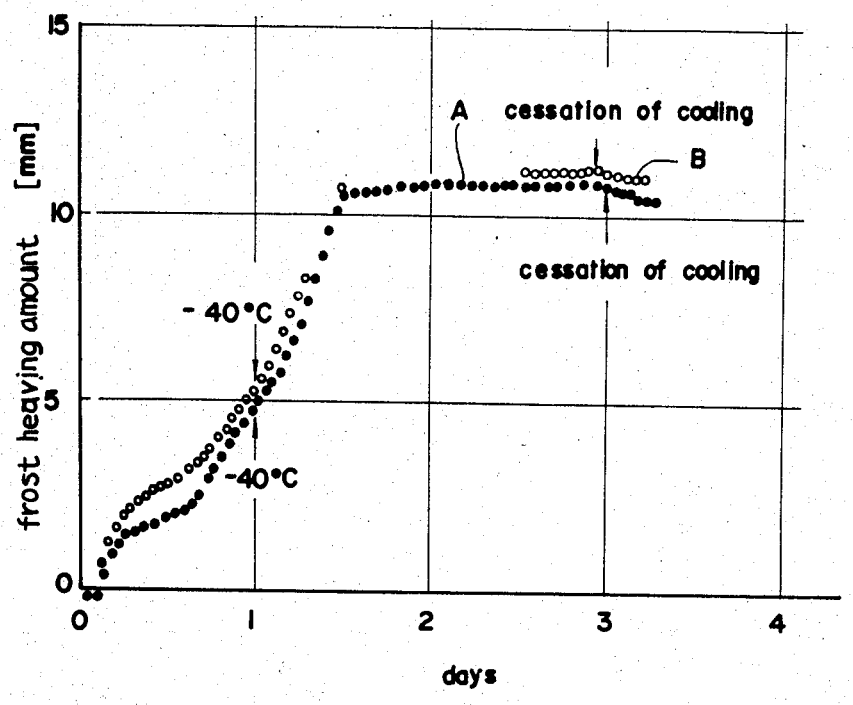
FIGS. 17 and 18 are graphic charts showing the results of tests on the frost damage proofness of inventive piles, conducted with the aid of the device shown in FIG. 16.
Figure 18:
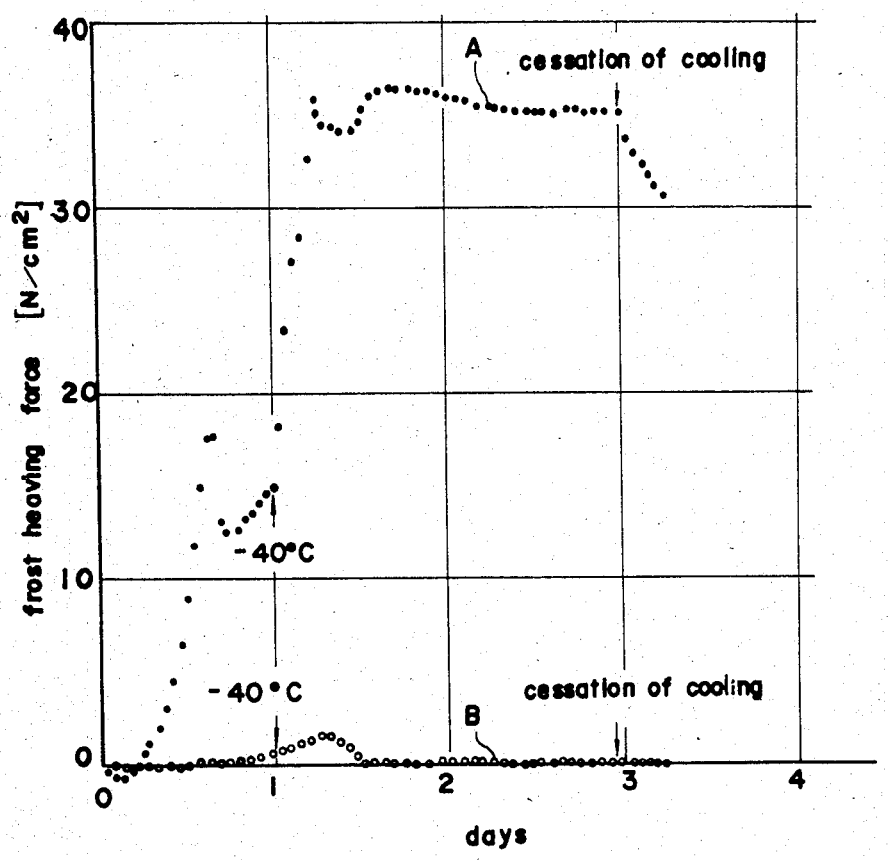

The conventinal steel tube pile and the inventive frost damage proof pile according to the present invention were installed in the respective test devices shown in FIG. 16. These devices were then installed in the refrigerating chamber which was cooled from ambient temperature to −20° C., maintained for about 24 hours, then cooled to −40° C. and maintained for about 48 hours until cooling was discontinued. FIG. 17 shows changes with time in the frost heaving amount of the soil 46 in the vessel 45, as measured with gauge 49. FIG. 18 shows changes with time of the frost heaving force as measured with load cell 48. In these figures, dots A represent test results on the conventional steel tube pile and blanked points B test results on the frost damage proofed pile according to the present invention. It is seen from these figures that, although the frost heaving amount remains the same for frost heaving force for the steel tube pile A is approximately 3.5 kg/cm$^2$, whereas that for the inventive frost damage proofed pile B is approximately nil! and thus substantially lower than in the case of the conventional steel tube pile.

TEST EXAMPLE II

The sample conventional steel tube test pile as that used in Test Example I and the same frost damage proofed test pile as that used in the embodiment of FIG. 10 were used. The test pile size was the same as in Test Example I. The sheath was made of chloroprene rubber and 1.5 mm thickness and 300 mm length. The spring used was made of stainless steel. The fluid material used was the same as that described in Test Example I.

Figure 19:
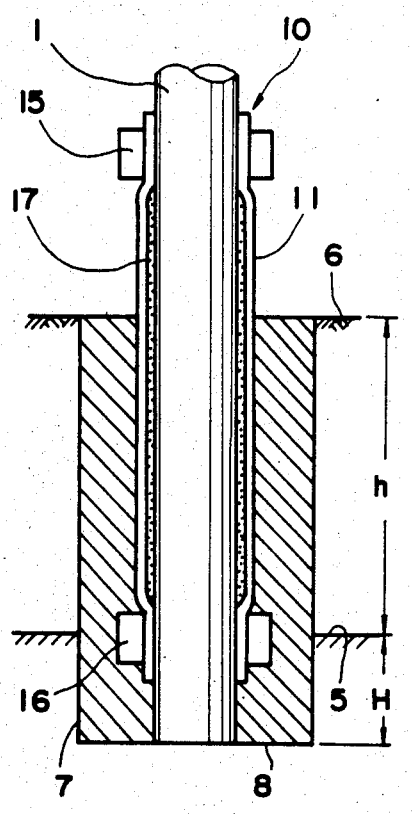
FIG. 19 is a longitudinal view showing a fifth embodiment of the present invention, in a first operating state.

These test piles were placed in the respective test devices as shown in FIG. 16 and tested in the manner as described in Test Example I. The test results comparable to those of the embodiment of FIG. 4 were obtained FIG. 19 shows a further embodiment of the present invention in longitudinal section In this figure, the numeral 11 designates a cylindrical sheath made of rubger or the similar elastic material The upper and lower parts of the sheath are secured water-tightly to the pile 1 at a location well above the ground surface with a fastener 15 and at or below the boundary between the permafrost 5 and the active layer 6 with a fastener 16, respectively The numeral 17 designates a fluid material filled substantially uniformly in the space between the pile 1 and the sheath 11. It is preferred that the fluid material 17 be used in as small an amount as possible.

In connection with material of the sheath 11 used in the present embodiment, it is generally required that (i) the material is not subject to brittle destruction in the temperature range from the ambient temperature of approximately 40° to −50° or thereabouts;

(ii) the strain (or elongation -contraction) of the material may undergo without permanent set on the aforementioned temperature range is larger than $(h_1-h)/h$ wherein h designates the thickness of the active layer 6 and $(h_1-h)$ the displacement caused by frost heaving to which the layer 6 is subject; and that (iii) the material is not attacked or otherwise deteriorated by the fluid material 17. It is to be noted however that the above requirements may be applied differently from one area to another. The following list 4 shows typical examples of the material satisfying the above requirements. It is to be understood that the materials shown in the list 2 may be used as fluid material 17.

List 4

Natural rubber, isoprene rubber, styrene-butadiene rubber, butadiene rubber, chloroprene rubber, butyl rubber, ethylene-propyrene rubber, ethylene-propyrene-diene rubber, chlorosulfonated polyethylene, nitrile-butadiene rubber, fluorine rubber, nitroso rubber, polyester urethane rubber, polyether urethane rubber, silicon fluoride rubber, phenyl-methylsilicon rubber, methylsilicon rubber, vinyl-silicon rubber, polysulfide rubber, polyolefinic plastic elastomer, thermoplastic urethane rubber, thermoplastic polyester elastomer, complex materials containing one or more of these materials (blends, copolymers, laminates etc.) with or without inorganic fillers.

Figure 20:
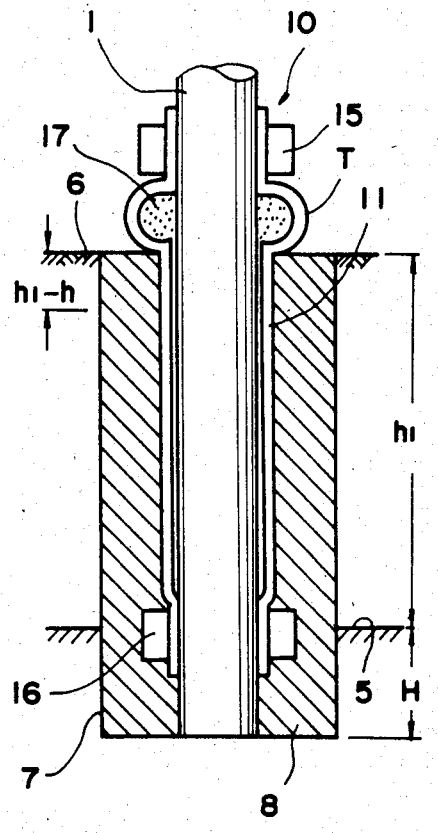
FIG. 20 is a view similar to FIG. 19 and showing the fifth embodiment in a second operating state.

The operation of the frost damage proofed pile of the present embodiment is hereafter described by referring to FIGS. 19 and 20.

When the active layer 6 is frozen in winter, the sand slurry 8 is also frozen and affixed on the surface of the sheath 11 applied to the pile 10. The pile 1 and the sheath 11 are slidable relative to each other with only negligible sliding resistance because of the presence of the fluid material. When the active layer 6 is frozen, the sheath 11 is extended so as to follow up with the soil heaving as shown in FIG. 20 for forming the expanded zone T between the ground surface and the fastener 15. With extension of the sheath 11, the gap between it and the pile 1 is reduced, so that the fluid material 17 in the gap is shifted upward and stored in the zone T. In this manner, the frost heaving force exerted by the active layer 6 on the pile 1 is absorbed by the sheath 11 and the fluid material 17 without being transmitted to the pile 1.

When the active layer 6 is thawed and sunk during summer, the sheath 11 is lowered so as to follow up with soil sinking to be returned to the state shown in FIG. 20. The negative friction produced with thawing and resulting sinking of the active layer 6 is absorbed by the fluid material 17 so that its effect on the pile 1 is substantially nill.

Again the tests were conduced in the refrigerating chamber in which the conventional steel tube pile and the pile of the present embodiment were embedded in the model ground. The test results are as follows.

TEST EXAMPLE III

The conventional steel tube pile same as that used in Test Example I and the frost damage proofed pile corresponding to the embodiment shown in FIG. 19 and having the size same as that of the Test Example I were used. The sheath applied to the latter was made of chloroprene rubber and 1.5 mm thick, 300 mm long and 29.5 mm inside diameter. The fluid material was same as that used in Test Example I.

Figure 21:
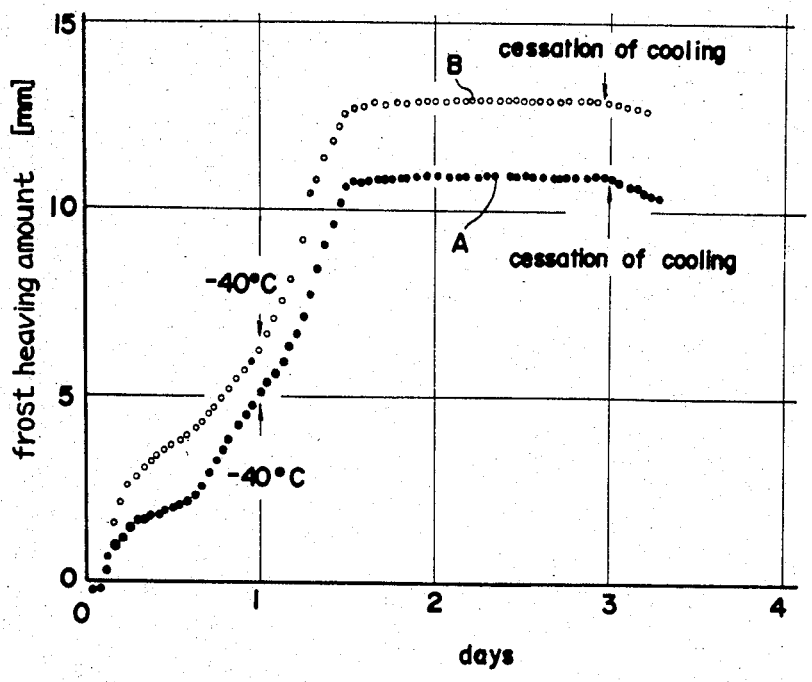
FIGS. 21 and 22 are graphic charts showing the results of similar tests, conducted with the aid of the device shown in FIG. 16.
Figure 22:
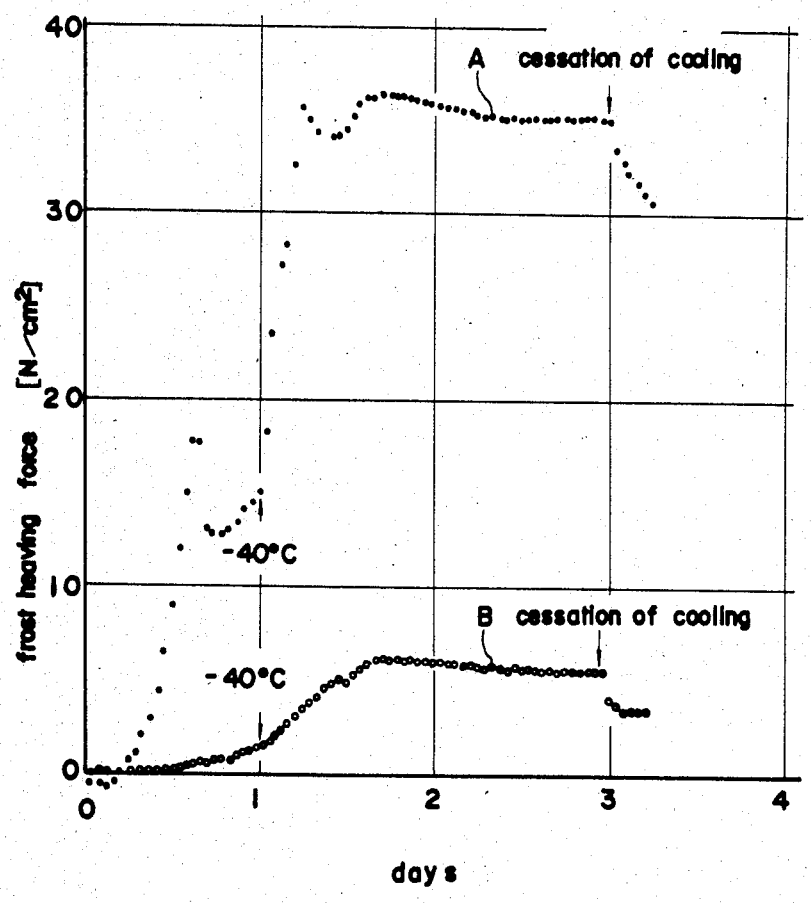

The above described steel tube pile and the frost damage proofed pile were installed in the respective test devices shown in FIG. 16, which devices were then installed in the refrigerating chamber for conducting the tests in the manner as described above. The test results are shown in FIGS. 21 and 22. It is seen from these figures that the frost damage proofed pile B of the present embodiment is subjected to a greater frost heaving amount than in the steel tube pile A and the frost heaving force applied to the steel tube pile A at −40° C. is approximately 3.5 kg/cm$^2$ whereas that applied to the pile B according to the present embodiment is approximately 0.5 to 0.6 kg/cm$^2$, which is markedly lower than the above value for test pile A.

In the embodiments shown in FIGS. 4, 7, 10, 14 and 19, the sheath 11 need be of a length L corresponding to a particular thickness h of the active layer 6 in the place where the pile is installed. Since the thickness h of the active layer 6 is markedly changed depending upon the particular topographical feature, it is necessary to make available in advance a number of types of piles 10 fitted with sheaths 11 of variable lengths L corresponding to variable thicknesses of the active layer 6.

Thus, when the frost damage proofed piles are installed as pile foundations for pipeline racks over an extended distance, it is required that various types of piles 10 with variable lengths of the sheath 11 be prefabricated at the factory and the piles 10 most suited to the thickness of the active layer 6 be selected at the construction site. This requires that the sheath 11 be packaged so as not to be destructed or deformed during transport, thus increasing the package size and possibly causing transport troubles which in turn gives rise to increased costs in manufacture and construction.

Figure 23:
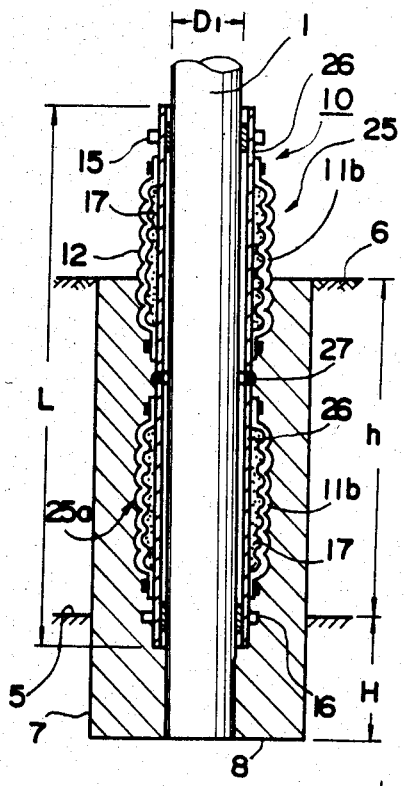
FIG. 23 is a longitudinal section showing a sixth embodiment of the present invention, in a first operating state.
Figure 24:
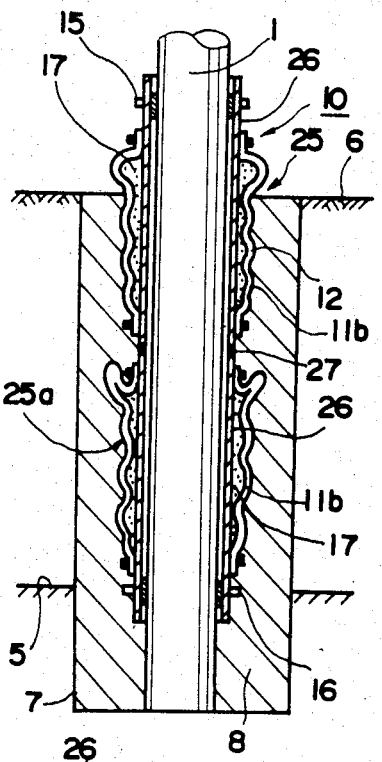
FIG. 24 is a view similar to FIG. 23 and showing said sixth embodiment in a second operating state.
Figure 25:
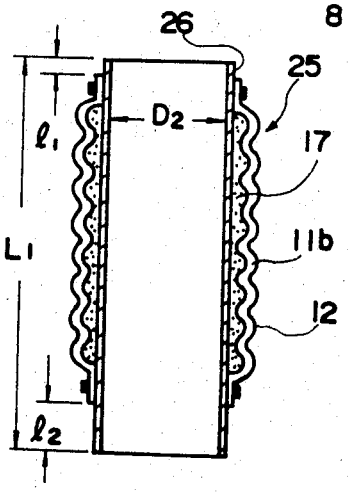
FIG. 25 is a longitudinal section showing essential portions of the sixth embodiment.

FIGS. 23 to 33 show still further embodiments of the present invention designed for overcoming these drawbacks. In an embodiment shown in FIG. 23, the numerals 25, **25*a* designate tubular units constructed as shown in FIGS. 25 by way of an example. The numeral 26 designates a tubular member constructed of a thin solid material and having an inside diameter $D_2$ slightly larger than the outside diameter $D_1$ of the pile 1, and a length $L_1$ of the unit 25, 25A equal to from about one-second to one-fourth of a total length L corresponding to thickness of the average active layer. The numeral 11*b* designates a sheath having substantially the same construction as the sheath 11 described in connection with FIG. 4. The upper and lower terminal portions of the sheath 11 are secured water-tightly to the tubular member 26. The fluid material 17 is filled in the space defined between the sheath 11*b* and the tubular member 26. The sheath 11*b* is secured to the tubular member 26 in such a manner that the upper end of the sheath 11*b* is located a distance $l_1$ below the upper extremity of the tubular member 26 and the lower end of the sheath is located a distance $l_2$ above the lower extremity of the tubular member 26 (with $l_2<l_1$). The tubular unit 25** is prefabricated at the factory and transported to the site of construction.

At the site of construction, the unit **25*a* is fitted over the pile 1 with the side of the clearance $l_2$ downwards. The lower and of the unit 25*a* is then secured with fastener 16 to the pile 1. Next, the other unit 25 is fitted on the top of the unit 25*a* with the side of the clearance $l_2$ directed upwards. The upper end of the unit 25 is secured with fastener 15 to the pile 1 so that a small gap is left between the opposite end parts of the units, and the both units are abutted end-to-end and connected as by welding 27. In the foregoing, description is made of two units 25, 25*a* connected to one another and to the pile 1. It is however to be understood that any suitable number of the units 25, 25*a* . . . may be fitted on the pile 1 and connected to one another depending on the thickness h of the active soil layer 6. The pile 10 thus constructed is located in the hole 7 and secured with backfill sand slurry 8**.

The operation of the present embodiment will be hereafter described by referring to FIGS. 23 and 24. When the active layer 6 is frozen and subjected to frost heaving in winter, the extendable section 12 is raised and extended correspondingly. At this time, the section 12 located in its entirety in the active layer 6 is deformed at the upper end thereof, whereas the section 12 partially exposed above the ground is deformed at a point above the ground surface. Thus the frost heaving force exerted by the layer 6 on the pile 10 is absorbed by the extendable section 12 without being transmitted to the pile 1.

When the active layer 6 is thawed in summer and thus subjected to sinking, the extensible sections 12 are lowered correspondingly and returned again to the state shown in FIG. 23. It should be noted that the negative friction generated with thawing and sinking of the active layer 6 is absorbed by the extensible sections 12 and the fluid material 17 without substnatially acting on the pile 1. It should also be noted that the ring members 19 as shown in FIG. 8 may be used in the present embodiment, in which case the extensible section 12 are formed as a spiral and the springs 18, 18*a* are interposed as shown in FIGS. 10 to 13.

Figure 26:
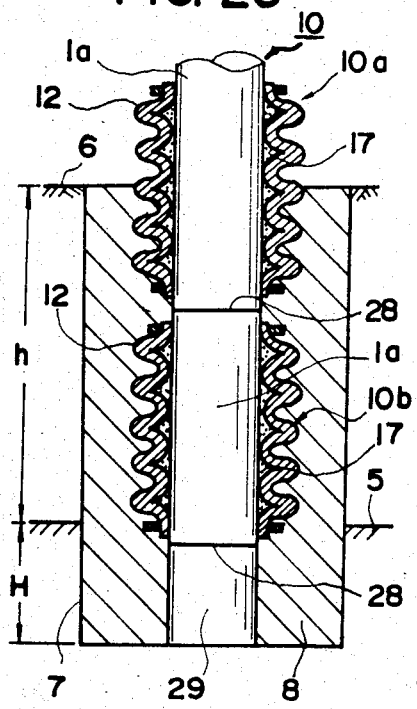
FIG. 26 is a longitudinal section showing a seventh embodiment of the present invention, in a first operating state.
Figure 27:
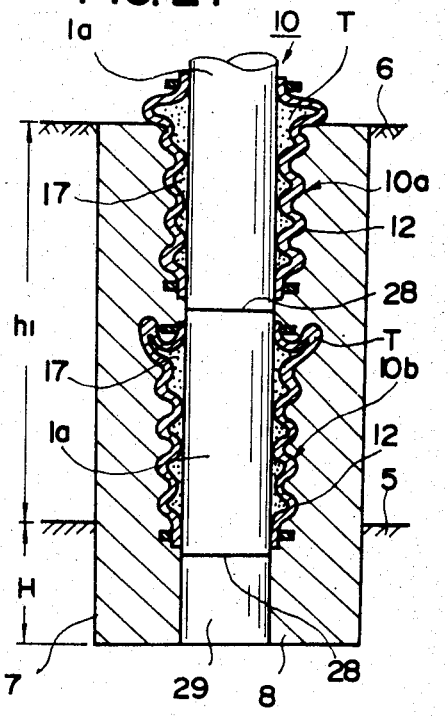
FIG. 27 is a view similar to FIG. 26 and showing said seventh embodiment in a second operating state.
Figure 28:
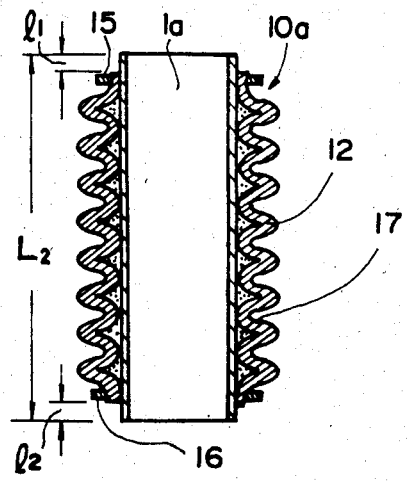
FIG. 28 is a longitudinal section showing essential parts of the seventh embodiment.

FIG. 26 shows a further embodiment of the present invention in longitudinal section. The numeral 10 designates a frost damage proofed pile according to the present invention and comprised of a plurality of pile sections 10*a*, 10*b*, . . . of suitable lengths connected to one another. FIG. 28 shows an example of the pile section 10*a*, 10*b* . . . The section pile 10*a* shown herein as steel tube pile, has a length $L_2$ equal to about one second or one-fourth of the active layer 6, as for example 0.5 m. The numeral 12 designates an extensible section in the form of bellows, the upper and lower ends of which are secured water-tightly to the pile section 10*a* at distance $l_1$,$l_2$ from the ends of the pile section 10*a* by means of fasteners 15, 16, respectively. The numeral 17 designates a fluid material filled in the gap between the pile 10*a* and the extensible sections 12. The numeral 29 designates a spacer to determine the location of the pile section 10*b*.

The aforementioned pile sections are prefabricated at the factory, packaged and transported to the site of construction, where the sections 10*a*, 10*b* . . . are abutted end-to end and connected as by welds 28 to a length corresponding to the thickness h of the active layer 6. The pile sections may be connected in advance and transported to the construction site when the active layer 6 is shown to be substantially unvariable in thickness.

The operation of the present embodiment is essentially similar to that of the embodiment shown in FIGS. 23 and 24.

Figure 29:
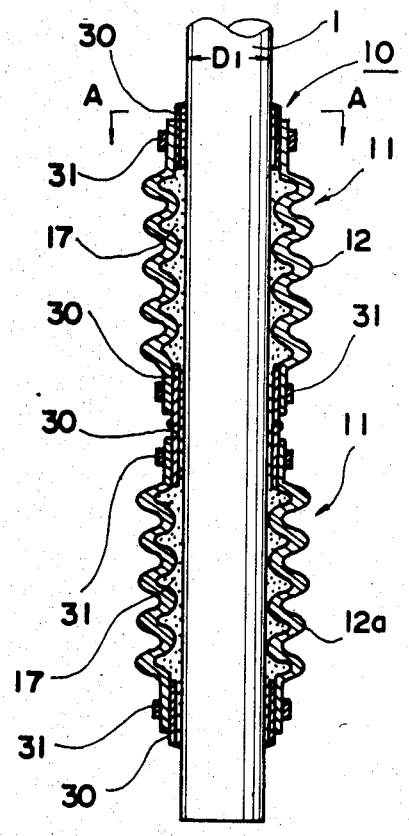
FIG. 29 is a longitudinal section showing an eighth embodiment of the present invention.
Figure 31:
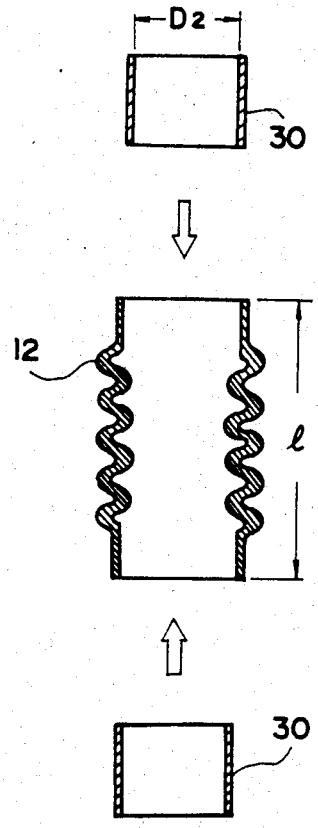
FIG. 31 is an exploded sectional view showing essential parts of the eighth embodiment.
Figure 30:
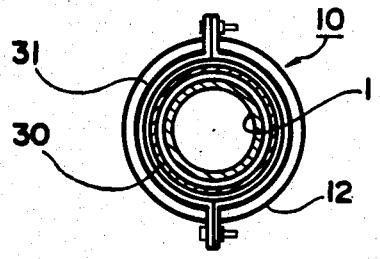
FIG. 30 is a section taken along line A—A of FIG. 29.

FIG. 29 is a longitudinal section showing a further embodiment of the invention, and FIG. 30 a section taken along line A—A in FIG. 29. The numerals 12, 12*a* designate extensible sections each being of a length l shorter than thickness h of the active layer 6, and the numerals 30 designate tubular sections constructed of thin metallic sheets and having an inside diameter $D_2$ slightly larger than the outside diameter $D_1$ of the pile 1. These tubular sections 30 are introduced into the upper and lower end parts of the extensible section 12 so as to be exposed partially, and are secured thereto water-tightly with a metallic fastener 31 for providing the sheath 11.

The sheaths 11 are prefabricated at the factory, packaged and transported to the site of construction where a number of sheaths 11 that gives a length corresponding to the thickness h of the active layer 6 are fitted on the pile 1 as shown in FIG. 29, the lowermost section 30 is secured water-tightly to the pile 1 as by welding, and the intermediate section or sections 30 are abutted end-to-end and connected to one another as by welding. When the fluid material 17 other than air is used, fluid material 17 is charged by way of a gap defined between the uppermost section 30 and the pile 1 and into the gap defined between the pile 1 and the sheaths 11. The uppermost section 30 is then secured water-tightly to the pile 1 as by welding.

The operation of the thus constructed frost damage proofed pile 10 is similar to that of the embodiment shown in FIGS. 23 and 26.

In the foregoing, it has been described that the sheaths 11 each comprized of an extensible section 12 and a pair of tubular sections 30 are prefabricated at the factory and transported to the site of construction where they are fitted on the pile 1, connected to one another at intermediate points and secured at the upper and lower parts to the pile 1. However, the above operation may be executed in a different manner in the present embodiment. Thus the extensible sections 12 and the tubular sections 30 are transported separately to the site of construction where the sections 30, 12 are alternately fitted to the pile until the length corresponding to the thickness of the active layer 6 is reached. The lowermost tubular section 30 is then secured to the pile 1 as by welding and the lower end of the extensible section 12 is fitted and secured to the tubular section 30 with a fastener 31. The upper end of the extensible section 12 is then fitted and secured to the lower half of the next tubular section 30, and the lower end of the next extensible section 12 is fitted and secured to the upper half of the tubular section 30. The extensible sections 12 are connected in this manner one after another by the tubular sections 30. When the length corresponding to the thickness h of the active layer 6 is reached, the fluid material 17 is charged and the uppermost section 30 secured to the pile 1.

Figure 32:
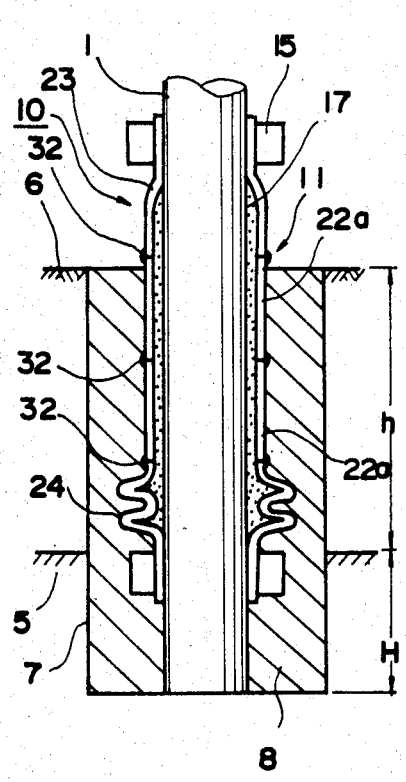
FIGS. 32 and 33 are longitudinal views showing ninth and tenth embodiments of the present invention, respectively.
Figure 33:
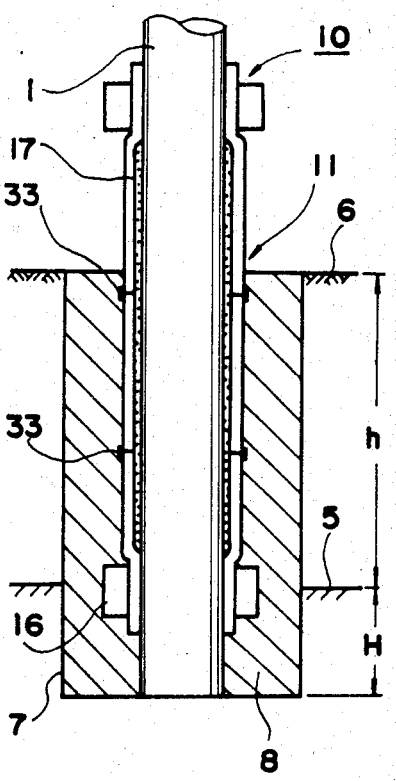

FIG. 32 shows an embodiment of the present invention wherein the tubular member 22 in the embodiment of FIG. 14 is divided into plural portions 22*a* of suitable lengths that may be connected at 32 to give a total length corresponding to the thickness of the active layer 6.

The operation of these embodiments is similar to that of the embodiments shown in FIGS. 14 and 19, respectively.

Figure 34:
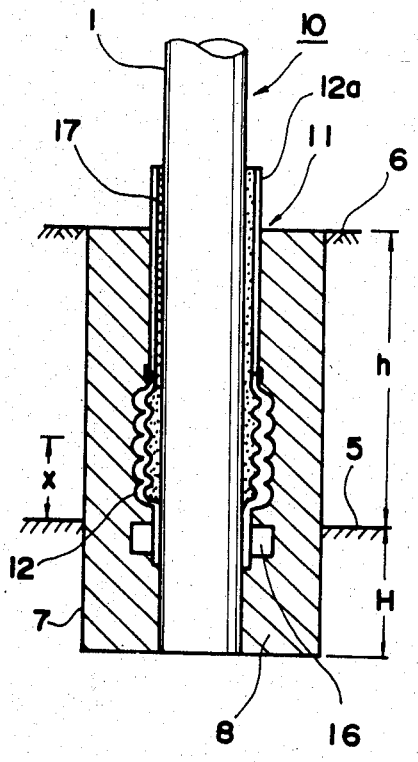
FIG. 34 is a longitudinal section showing an eleventh embodiment of the present invention, in a first operating state.
Figure 35:
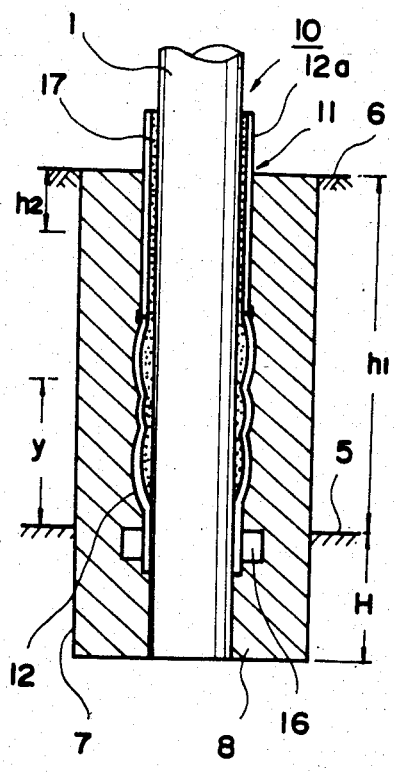
FIG. 35 is a view similar to FIG. 34 and showing the eleventh embodiment in a second operating state.

FIG. 34 shows a further embodiment of the present invention in longitudinal section. The numeral 11 designates a sheath comprised of a tubular section 12*a* having an inside diameter slightly larger than the outside diameter of the pile 1, and an extensible section 12 integrally connected to the tubular section 12*a*. The lower end of the sheath is secured water-tightly to the pile 1 by means of a fastener 16. The numeral 17 designates a fluid material filled in the space between the pile 1 and the sheath 11. It should be noted that the extensible section 12 is designed for satisfying the relation $$x+h_2<=y$$

where x represents the length thereof in the compressed state, y the length thereof in the extended state and $h_2$ the frost heaving amount of the active layer. It should be noted that the extensible section 12 is situated in the layer 6 upon locating the pile 10 and that the lower end of the sheath 11 is secured to the pile 1 at or below the boundary zone between the active layer 6 and the permafrost 5.

The materials of the tubular section 12*a* of the sheath 11 used in the present embodiment is generally selected so that (i) it is not subject to brittle destruction in the range from ambient temperature of approximately 40° C. to a lower temperature of approximately equal to −50° C.;

(ii) it is substantially not deformed by the frost heaving of the active layer 6; and (iii) it is not deteriorated or attacked by the fluid material 17, although these requirements may be applied differently from one area to another.

The following list 5 shows typical materials capable of satisfying these conditions.

List 5 various types of polyethylene, polypropyrene, polyoxymethylene, polybutene-1, poly-1-pentene, polyvinylidene chloride, poly-tetra fluoro ethylene, polyamid 6 (nylon 6), polyamid 6.6. (nylon 6.6.), vinyl acetate-ethylene copolymer, acrylate-acrylonitrile copolymer, complex materials containing one or more of these materials (blends, copolymers or laminates) with or without inorganic fillers.

Similarly, the material of the extensible section 12 is generally selected so that (i) it is not subject to brittle destruction in the range from the ambient temperature of approximately 40° C. to an extremely low temperature approximately equal to −50° C.;

(ii) the strain it undergoes without causing permanent set is larger than the frost heaving amount $h_2$ of the active layer 6; and (iii) it is free from deterioration or corrosive action of the fluid material 17.

It is to be noted that the above requirements may be applied differently from one area to another. The following list 6 shows typical materials capable of satisfying these requirements. When the tubular section 12*a* and the extensible section 12 are constructed of the same material, the two sections may be constructed unitarily i.e. without physical separation. It should be noted that the materials shown in the list 2 may be used as fluid material 17, with exclusion of the gaseous substances.

List 6

Extensible structures same as those shown in List 1; and cylindrical or extensible structures comprising complex materials containing one or more of the natural rubber, isoprene rubber, styrene-butadiene rubber, butadiene rubber, chloroprene rubber, butyl rubber, ethylenepropyrene rubber, ethylene-propyrene-diene rubber, nitroso rubber, polyester urethane rubber, polyether urethane rubber, silicon fluoride rubber, phenyl-methyl-silicon rubber, methyl silicon rubber, vinyl silicon rubber, polysulfide rubber, epichlorohydrine rubber, styrene-chloroprene rubber and styrene isoprene rubber.

The frost damage proofed pile thus constructed is installed as in the embodiment shown in FIG. 4

When the active layer 6 is frozen in winter, sand slurry 8 is also frozen and affixed to the surface of the sheath 11 applied to the pile 1. The sliding resistance between the pile 1 and the sheath 11 is low because of the presence of the fluid material 17 between the pile and the sheath. Thus, in the event of frost heaving of the active layer 6, the tubular section 12*a* is also raised correspondingly and the extensible section 12 is extended owing to frost heaving of the active layer 6 and the resulting upward movement of the tubular section 12*a*.

With extension of the section 12, the fluid material 17 charged into the space between the pile 1 and the extensible section 12 is displaced upwards. In this manner, the frost heaving force exerted by the active layer 6 on the pile 1 is absorbed by the extensible section 12*a* without being transmitted to the pile 1.

When the active layer 6 is thawed and subsided in summer, the sheath 11 is lowered correspondingly and the extensible section 12 is contracted to the state shown in FIG. 34. The negative friction produced with thawing and resulting sinking of the active layer 6 is absorbed by the fluid material 17 so that is effect on the pile 1 is substantially nill.

In the present embodiment, the extensible section 12 of the sheath 11 may be formed as a spiral and coil spring means may be provided on the outer periphery of the roots and/or the inner periphery of the crests. In this manner, the sheath 11 may be returned more smoothly to its summer position with thawing and sinking of the sheath 11, while the section 12 may be protected from fracture or deformation otherwise caused under the pressure of the active layer 6. The coil spring means may be embedded in the extensible section 12 if desired.

Tests were conducted in a refrigerating chamber using conventional steel tube pile and the frost damage proofed pile of the present invention as shown in the Test Example IV.

TEST EXAMPLE IV

The conventional steel tube test pile similar to that used in Test Example I was used. The inventive frost damage proofed pile was of the same size as that used in Test Example I and comprised of the tubular section of low density polyethylene which was 1.5 mm thick, 250 mm long and 29.5 mm inside diameter, and the extensible section of chloroprene rubber which was 2 mm thick and 50 mm long. Silicon grease was used as fluid material.

Figure 36:
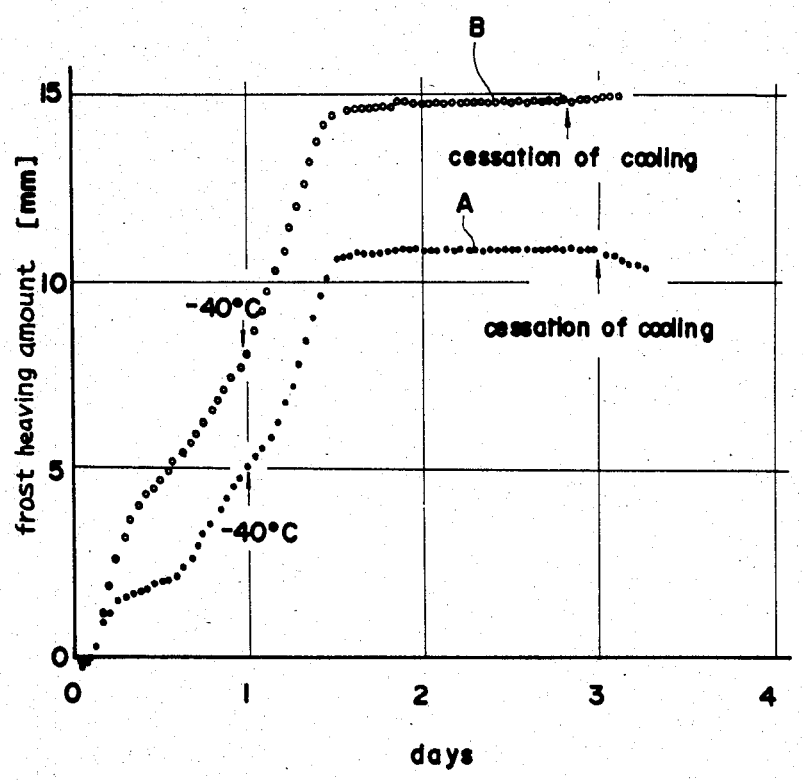
FIGS. 36 and 37 are graphic charts showing the results of tests on the conventional steel tube pile and the pile according to the eleventh embodiment of the present invention, conducted with the aid of the device shown in FIG. 16.
Figure 37:
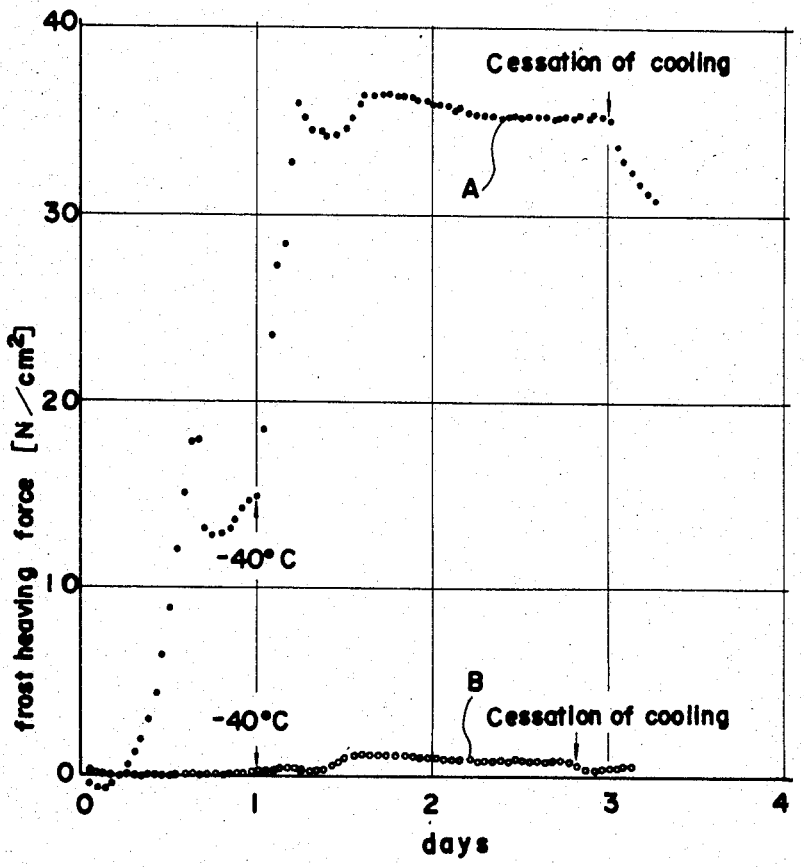

The above described conventional and inventive piles were built into respective test devices shown in FIG. 6 and tested in the manner described above. The test results are shown in FIGS. 36 and 37. It may be seen from these figures that, although the frost damage proofed pile B of the present invention is subjected to a larger frost heaving amount than that experienced by the conventional pile A, the frost heaving force exerted to the pile A at −40° C. is approximately 3.5 kg/cm$^2$, whereas that exerted to the frost damage proofed pile B was approximately 0 to 0.1 kg/cm$^2$ and thus negligible.

Figure 38:
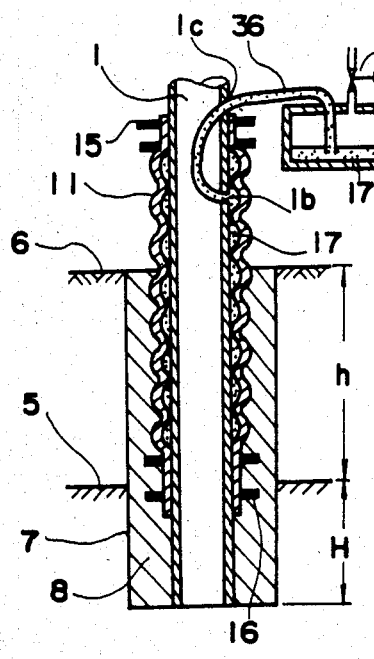
FIG. 38 is a longitudinal section showing a twelfth embodiment of the present invention, in a first operating state.
Figure 39:
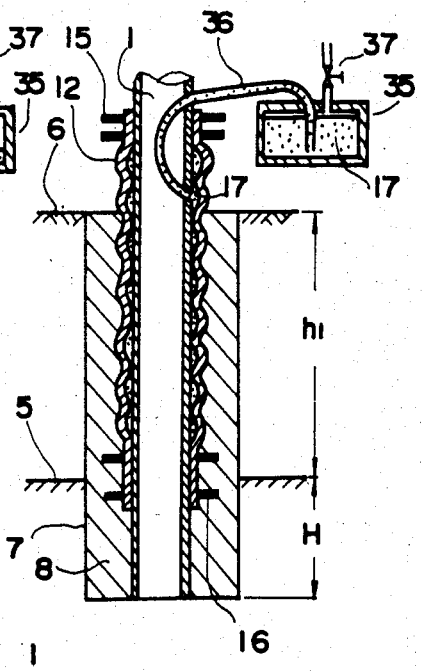
FIG. 39 is a view similar to FIG. 38 and showing the twelfth embodiment in a second operating state.

A further embodiment of the present invention is shown in FIGS. 38 and 39. In the embodiments shown in FIGS. 5, 11, 15, 20, 24 and 27, when the active layer 6 is subjected in winter to frost heaving, the expanded zone T is temporarily formed between the upper fixed portion of the extensible section 12 and the ground surface for storage of the fluid material 17 displaced with the extension of the section 12. In summer, the original state is restored. By repetition of the above described sequence of operations, the extensible section 12 is subjected to an excess load of alternate extension and contraction. This may cause damage or deteriorate the properties of the extensible section 12 through fatigue on prolonged usage to lower the function of the frost damage proofed pile.

In an embodiment of the present invention shown in FIG. 38, a tank 35 consisting essentially of a hermetically sealed vessel is connected to the pile 1 through a pipe 36 having its one end secured in an opening $1_b$ formed in the wall of the pile 1 for opening into a space defined by the pile 1 and the extensible section 12 and its other end taken out of the pile 1 through another opening $1_c$ in the pile wall to be fitted to the tank 35 for opening into the interior of the tank 35 in such a manner that the space defined between the pile 1 and the extensible section 12 communicates with the interior of the tank 35 through pipe 36.

In the above construction, the space between the pile 1 and the extensible section 12 is filled with the fluid material 17 in summer as shown in FIG. 38. In winter, when the active layer 6 is frozen and thus subjected to frost heaving, the extensible section 12 being then deformed, the fluid material 17 flows into tank 35 through pipe 36 as shown in FIG. 39. Thus the extensible section 12 is not subjected to excess deformation at the expanded zone T. The tank 35 is connected to a source of pneumatic pressure, not shown, through a valve 37, in such a manner that, when the active layer 6 undergoes thawing and consequent sinking in summer, the inside of the tank 35 is pressurized for forwarding the fluid material 17 into the space between the pile 1 and the extensible section 12 and that, when the layer 6 is frozen and undergoes frost heaving in winter, the interior of the tank 35 may be depressurized for sucking the fluid material back into tank 35. The tank may also be used for pumping the fluid material 17 into the space between the pile 1 and the extensible section 12 after the upper and lower ends of the section 12 are secured to the pile and the pile embedded in the hole as described above.

Figure 40:
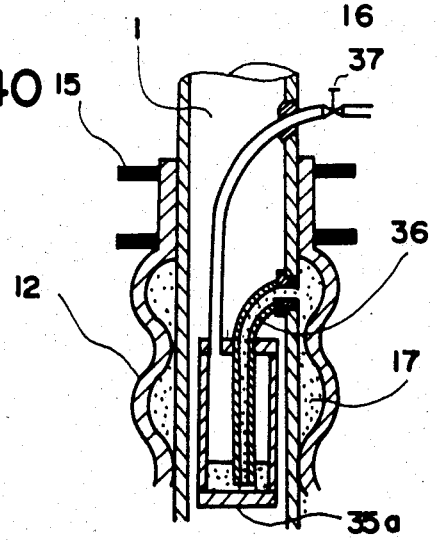
FIG. 40 is a longitudinal view showing essential parts of the twelfth embodiment.

FIG. 40 shows essential portions of still another embodiment of the present invention, according to which a tank 35*a* is mounted within the interior of the pile 1. The operation of the present embodiment is similar to that of the embodiment shown in FIG. 38.

What is claimed is:

1. In a frost damage proofed pile installed in a frigid area where the pile is subjected to a frost heaving force, the improvement comprising a tubular sheath member fitted over the pile surface, said sheath member having a length longer than the thickness of an active or seasonally frozen soil layer of the terrain in which the pile is installed, at least a portion of said length defined by a series of ribs extending transversely outwardly of said sheath member relative to a lengthwise axial line as an extensible section, the lower end of said sheath member being secured to the pile at or below a position corresponding to the bottom region of said active or seasonally frozen soil layer, the upper end of the sheath member being secured to the pile at a position above the ground surface, and a fluid material being filled in a space defined between said pile and the sheath member.

2. The frost damage proofed pile according to claim 1 wherein the extensible section of the sheath member is situated within a zone ranging from the position corresponding to the bottom of the active or seasonally frozen soil layer to a position above the ground surface.

3. The frost damage proofed pile according to claim 1 wherein a plurality of sheath members are arranged in tandem for covering a predetermined length corresponding to the thickness of the active or seasonally frozen soil layer.

4. The frost damage proofed pile according to claim 1 wherein the sheath member is formed as a cylindrical member of elastic material.

5. The frost damage proofed pile according to claim 1 wherein the extensible section of the sheath member is in the form of a spiral.

6. The frost damage proofed pile according to claim 1 wherein the extensible section of the sheath member is in the form of a spiral and wherein coil spring means are placed on at least one of the inner surface and the outer surface of the extensible section of the sheath member along said spiral.

7. The frost damage proofed pile according to claim 1 wherein the extensible section of said sheath member is in the form of a bellows.

8. The frost damage proofed pile according to claim 1 wherein the extensible section of said sheath member is in the form of a bellows, and wherein a plurality of ring members are placed within the roots of said bellows on at least one of the inner surface and the outer surface of the extensible section of the sheath member.

9. The frost damage proofed pile according to claim 1 wherein a solid lubricating coating is formed on the outer peripheral surface of the pile.

10. The frost damage proof pile according to claim 1 wherein a tank for storage of the fluid material is provided for communicating with said space of the extensible section of the sheath member.

11. In a frost damage proofed pile installed in a frigid area where the pile is subjected to a frost heaving force, the improvement comprising a sheath unit, said sheath unit having a cylindrical member of an inside diameter slightly larger than the outside diameter of the pile and an axially extensible tubular member fitted on the outer periphery of said cylindrical member and having its upper and lower ends secured to said cylindrical member, said tubular member having at least a portion of its length defined by a series of ribs extending transversely outwardly of said sheath unit relative to a lengthwise axial line, with a fluid material being filled in a space confined between said cylindrical and axially extensible members, and wherin said sheath unit is fitted on the outer surface of the pile over a length greater than the thickness of an active or seasonally frozen soil layer of a terrain in which the pile is installed, the lower end of said sheath unit being secured to the pile at or below the bottom region of said soil layer.

12. The frost damage proofed pile according to claim 11 wherein the upper end of said sheath unit is secured to the pile at a position above the ground surface.

13. The frost damage proofed pile according to claim 11 wherein a plurality of said sheath units are connected in tandem to one another for a predetermined length corresponding to the thickness of the active or seasonally frozen soil layer.

14. The frost damage proofed pile according to claim 11 wherein the extensible member of said sheath unit comprises a cylindrical member of elastic material.

15. The frost damage proofed pile according to claim 11 wherein the extensible member of said sheath unit is in the form of a spiral.

16. The frost damage proofed pile according to claim 11 wherein the extensible member of the sheath unit is in the form of a spiral and wherein coil spring means are placed along said spiral on at least one of the inner surface and the outer surface of said extensible member.

17. The frost damage proofed pile according to claim 11 wherein said extensible member of said sheath unit is in the form of a bellows.

18. The frost damage proofed pile according to claim 11 wherein the extensible member of said sheath unit is in the form of a bellows, and wherein a plurality of ring members are placed on at least one of the inner surface and the outer surface of said extensible member so as to lie on the roots of said bellows.

19. The frost damage proofed pile according to claim 11 wherein a solid lubricating coating is formed on the outer periphery of said cylindrical member.

20. The frost damage proofed pile according to claim 11 wherein a tank containing the fluid material is provided for communicating with said space of the extensible member of the sheath unit.

21. In a frost damage proofed pile installed in a frigid district where the pile is subject to a frost heaving force, the improvement comprising a plurality of pile units, each said pile unit having a pile segment cut to a predetermined length and an axially extensible tubular member fitted to the outer surface of said pile segment, said tubular member having at least a portion of its length defined by a series of ribs extending transversely outwardly of said tubular member relative to a lengthwise axial line and having its upper and lower ends secured to the outer surface of said pile segment at positions ahead of the upper and lower ends of said pile segment, with a fluid material being filled in the space between the pile segment and the extensible member, and wherein a number of said pile segments are connected to one another for covering a distance longer than the thickness of an active or seasonally frozen soil layer of the terrain in which the pile is installed.

22. The frost damage proofed pile according to claim 21 wherein the extensible member comprises a cylindrical member of resilient material.

23. The frost damage proofed pile according to claim 21 wherein the extensible member is in the form of a spiral.

24. The frost damage proofed pile according to claim 21 wherein the extensible member is in the form of a sprial, and wherein coil spring means are placed along said spiral on at least one of the inner surface and the outer surface of said extensible member.

25. The frost damage proofed pile according to claim 21 wherein the extensible member is in the form of a bellows.

26. The frost damage proofed pile according to claim 21 wherein the extensible member is in the form of a bellows, and wherein a plurality of ring members are placed on at least one of the inner surface and the outer surface of said extensible member so as to lie on the roots of said bellows.

27. The frost damage proofed pile according to claim 21 wherein a solid lubricating coating is provided to the outer periphery of the pile segment.

28. The frost damage proofed pile according to claim 21 wherein a tank containing the fluid material is provided for communicating with the space of said extensible member.

29. In a frost damage proofed pile installed in a frigid district where the pile is subjected to a frost heaving froce, the improvement comprising a plurality of sheath units, each said sheath unit having in turn an axially extensible tubular member, said tubular member having at least a portion of its length defined by a series of ribs extending transversely outwardly of said tubular member relative to a lengthwise axial line and a pair of cylindrical sections fitted into and secured to both opening ends of the tubular member so that the mouth ends thereof are exposed to the outside of said extensible member, said cylindrical sections being of an inside diameter slightly larger than the outside diameter of the pile segment;

wherein a number of said sheath units are connected to one another in tandem and placed over the pile for covering a predetermined length corresponding to the thickness of an active or seasonally frozen soil layer of the terrain in which the pile is installed; and wherein the lower end of the lowermost one of said sheath units is secured to the pile at or below the position corresponding to the bottom region of said active or seasonally frozen soil layer, wherein the upper end of the uppermost one of said sheath units is secured to the pile at a position above the ground surface, and with a fluid material being filled in a space defined between the pile and the sheath unit.

30. The frost damage proofed pile according to claim 29 wherein the extensible member of said sheath unit comprises a cylindrical member of elastic material.

31. The frost damage proofed pile according to claim 29 wherein the extensible member of said sheath unit is in the form of a spiral.

32. The frost damage proofed pile according to claim 29 wherein the extensible member of said sheath unit is in the form of a spiral, and wherein coil spring means are placed along said spiral and on at least one of the inner surface and the outer surface of said extensible member.

33. The frost damage proofed pile according to claim 29 wherein the extensible member of said sheath unit is in the form of a bellows.

34. The frost damage proofed pile according to claim 29 wherein the extensible member of said sheath unit is in the form of a bellows, and wherein a plurality of ring members are placed on at least one of the inner surface and the outer surface of said extensible member so as to lie on the roots of said bellows.

35. The frost damage proofed pile according to claim 29 wherein a solid lubricating coating is provided to the outer surface of the pile.

36. The frost damage proofed pile according to claim 29 wherein it further comprises a tank containing a fluid material and communicating with the space of said extensible member.

* * * * *

UNITED STATES PATENT AND TRADEMARK OFFICE

CERTIFICATE OF CORRECTION

PATENT NO. : 4,585,681

DATED : April 29, 1986

INVENTOR(S) : Kenji KIDERA et al

It is certified that error appears in the above-identified patent and that said Letters Patent is hereby corrected as shown below:

Please add the identification of the Assignee as follows to the title page:

-- [73] Assignee: Nippon Kokan Kabushiki Kaisha
Tokyo, Japan --

Signed and Sealed this

Twenty-fifth Day of November, 1986

*Attest:*

DONALD J. QUIGG

*Attesting Officer* *Commissioner of Patents and Trademarks*